US011026471B2

(12) United States Patent
Hillyer

(10) Patent No.: US 11,026,471 B2
(45) Date of Patent: Jun. 8, 2021

(54) FOOTWEAR ATTACHMENT ASSEMBLY

(71) Applicant: DECKERS OUTDOOR CORPORATION, Goleta, CA (US)

(72) Inventor: Christopher Hillyer, Goleta, CA (US)

(73) Assignee: DECKERS OUTDOOR CORPORATION, Goleta, CA (US)

( * ) Notice: Subject to any disclaimer, the term of this patent is extended or adjusted under 35 U.S.C. 154(b) by 0 days.

(21) Appl. No.: 15/663,047

(22) Filed: Jul. 28, 2017

(65) Prior Publication Data

US 2017/0325541 A1 Nov. 16, 2017

Related U.S. Application Data

(62) Division of application No. 14/926,266, filed on Oct. 29, 2015, now Pat. No. 10,602,796.

(51) Int. Cl.

*A43B 3/10* (2006.01)
*A43B 3/12* (2006.01)
*A43B 3/24* (2006.01)

(52) U.S. Cl.

CPC ..... *A43B 3/244* (2013.01); *A43B 3/103* (2013.01); *A43B 3/122* (2013.01); *A43B 3/128* (2013.01)

(58) Field of Classification Search

CPC ..... A43B 3/103; A43B 3/122; A43B 3/24; A43B 3/244
USPC ..... 36/15, 100, 101
See application file for complete search history.

(56) References Cited

U.S. PATENT DOCUMENTS

| | | | | |
|---|---|---|---|---|
| 2,238,274 A | | 4/1941 | Lyness | |
| 2,367,092 A | | 1/1945 | Blotner | |
| 2,526,940 A | | 10/1950 | Fello | |
| 2,680,309 A | | 12/1951 | Peterson | |
| 2,801,478 A | | 8/1957 | Gilbert | |
| 4,172,330 A | | 10/1979 | Kao | |
| 4,450,633 A | * | 5/1984 | Connelly | A43B 1/0054 36/101 |
| 4,497,123 A | | 2/1985 | Ehrlich | |
| 4,793,075 A | * | 12/1988 | Thatcher | A43B 3/126 12/142 S |
| 6,237,250 B1 | * | 5/2001 | Aguerre | A43B 3/122 36/11.5 |

(Continued)

FOREIGN PATENT DOCUMENTS

| | | | |
|---|---|---|---|
| EP | 0365494 | A2 | 4/1990 |
| GB | 402678 | A | 12/1933 |

(Continued)

*Primary Examiner* — Sharon M Prange
(74) *Attorney, Agent, or Firm* — Greer, Burns & Crain, Ltd.

(57) ABSTRACT

An article of footwear including an upper having a strap assembly with a plurality of straps, where a plurality of the straps have outsole connectors, and at least one removable connecting member is configured to interconnect a plurality of the straps. The article of footwear also includes a sole including a top surface, a bottom surface and a plurality of through-holes positioned on the sole, where the plurality of the straps including the outsole connector are inserted through a corresponding one of the through-holes until a bottom surface of each outsole connector is substantially flush with the bottom surface of the sole to secure the strap assembly to the sole, and at least two of the straps are interconnected by the at least one removable connecting member.

7 Claims, 21 Drawing Sheets

(56) References Cited

U.S. PATENT DOCUMENTS

| | | | | |
|---|---|---|---|---|
| 7,823,299 | B1 | 11/2010 | Brigham | |
| 8,051,581 | B2 | 11/2011 | Aveni | |
| 8,353,116 | B2 | 1/2013 | Berrins | |
| 8,387,282 | B2 | 3/2013 | Baker et al. | |
| 8,413,350 | B2 * | 4/2013 | Scozzafava | A43B 3/122 36/101 |
| 8,776,400 | B2 | 7/2014 | James et al. | |
| 9,402,436 | B2 * | 8/2016 | Blowers | A43B 3/244 |
| 9,603,409 | B2 * | 3/2017 | Blowers | A43B 3/122 |
| 2004/0181972 | A1 | 9/2004 | Csorba | |
| 2006/0026861 | A1 * | 2/2006 | Manzi | A43B 3/122 36/11.5 |
| 2006/0174514 | A1 * | 8/2006 | Scozzafava | A43B 3/122 36/11.5 |
| 2010/0037487 | A1 | 2/2010 | Connett | |
| 2010/0088927 | A1 | 4/2010 | Spinelli | |
| 2011/0239484 | A1 * | 10/2011 | Giovannetti | A43B 3/103 36/11.5 |
| 2011/0277345 | A1 | 11/2011 | Luiz | |
| 2012/0204441 | A1 * | 8/2012 | Conner | A43B 3/103 36/11.5 |
| 2013/0340285 | A1 * | 12/2013 | Blowers | A43B 3/244 36/101 |
| 2014/0130372 | A1 | 5/2014 | Aveni et al. | |
| 2014/0165426 | A1 * | 6/2014 | Chapin | A43B 3/103 36/100 |
| 2015/0128447 | A1 * | 5/2015 | Verona | A43B 3/122 36/11.5 |

FOREIGN PATENT DOCUMENTS

| | | |
|---|---|---|
| WO | 2008117270 | 10/2008 |
| WO | 2010051586 | 5/2010 |
| WO | 2014071964 | 5/2014 |

* cited by examiner

FOOTWEAR ATTACHMENT ASSEMBLY

CROSS-REFERENCE TO RELATED APPLICATIONS

This application is a divisional of and claims priority to U.S. patent application Ser. No. 14/926,266 filed on Oct. 29, 2015, the entire contents of which is incorporated herein by reference.

BACKGROUND

The present application relates generally to footwear, and more particularly to an attachment assembly for connecting footwear components.

Different types of footwear are made by connecting several footwear components together such as footwear uppers, midsoles and outsoles. Some articles of footwear, such as sandals, include uppers and outsoles and other types include uppers, midsoles, outsoles and other components. Typically, these footwear components are connected by gluing, stitching or molding the components together or by a combination of these methods. Due to the complexity of manufacturing process, footwear components are usually made and connected together at one facility.

Also, footwear component connection methods are meant to be permanent to enhance the quality and durability of the articles of footwear. Therefore, if a consumer wants different footwear colors or designs of a particular shoe style, they must purchase several pairs of that shoe style.

It is therefore desirable to provide footwear components that can be manufactured and assembled at different locations, that are easily connected together and that are also removable and replaceable to form different shoe styles without the added cost of purchasing multiple pairs of a particular shoe style.

SUMMARY

The present article of footwear includes an attachment assembly that secures an upper to a sole by inserting ends of the upper through the sole and securing the ends of the upper to the sole using a securing member. The securing member is easily attached to the ends of the upper and attached to and removable from the sole to enable quick assembly of the article of footwear at any location and to enable the upper to be removed and replaced with another upper that may be the same as or different from the removed upper.

An embodiment of the present article of footwear is provided and includes an upper and a sole. The upper includes at least two supports where each of the supports includes an end and the sole includes a top surface, a bottom surface and at least two slots extending from the top surface to the bottom surface, where the bottom surface includes a channel. A securing member is attached to each of the ends of the supports and inserted in the channel for securing the upper to the sole.

In another embodiment, an article of footwear is provided and includes an upper and a sole. The upper includes a plurality of supports, where each of the supports includes tabs, and the sole includes a top surface, a bottom surface and a plurality of slots positioned along a periphery of the sole and extending from the top surface to the bottom surface, where the bottom surface includes a channel extending along the periphery of the sole. A securing member is attached to each of the tabs and inserted in the channel for securing the upper to the sole.

In a further embodiment, an article of footwear is provided and includes an upper having a strap assembly with a plurality of straps, where a plurality of the straps have outsole connectors, and at least one removable connecting member is configured to interconnect a plurality of the straps. The article of footwear also includes a sole including a top surface, a bottom surface and a plurality of through-holes positioned on the sole, where the plurality of the straps including the outsole connector are inserted through a corresponding one of the through-holes until a bottom surface of each outsole connector is substantially flush with the bottom surface of the sole to secure the strap assembly to the sole, and at least two of the straps are interconnected by the at least one removable connecting member.

Figure 13A:
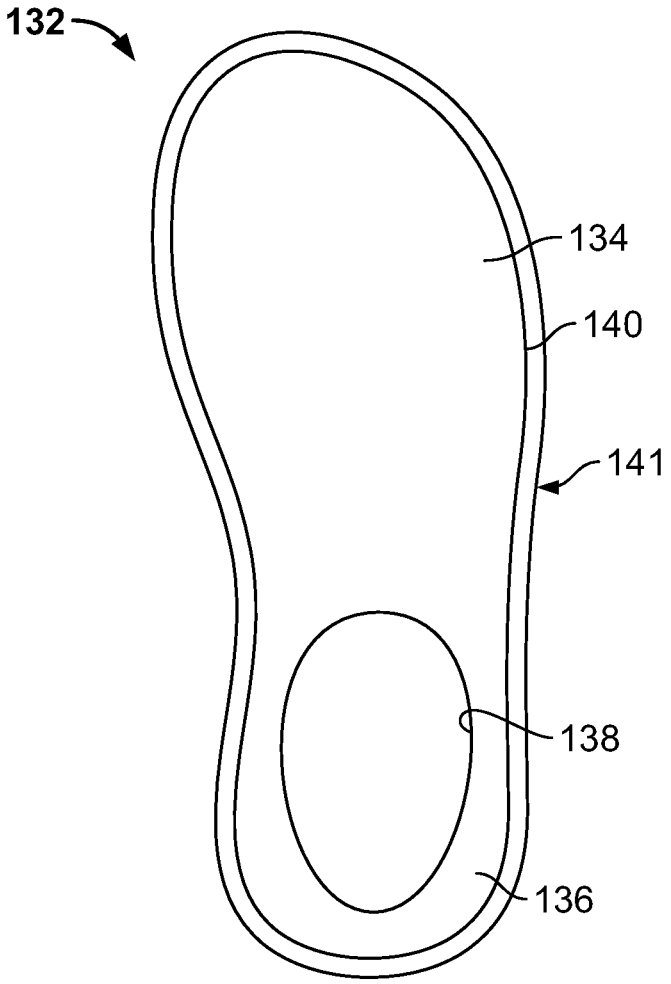
FIG. 13A is a top view of another embodiment of the present article of footwear.
Figure 13B:
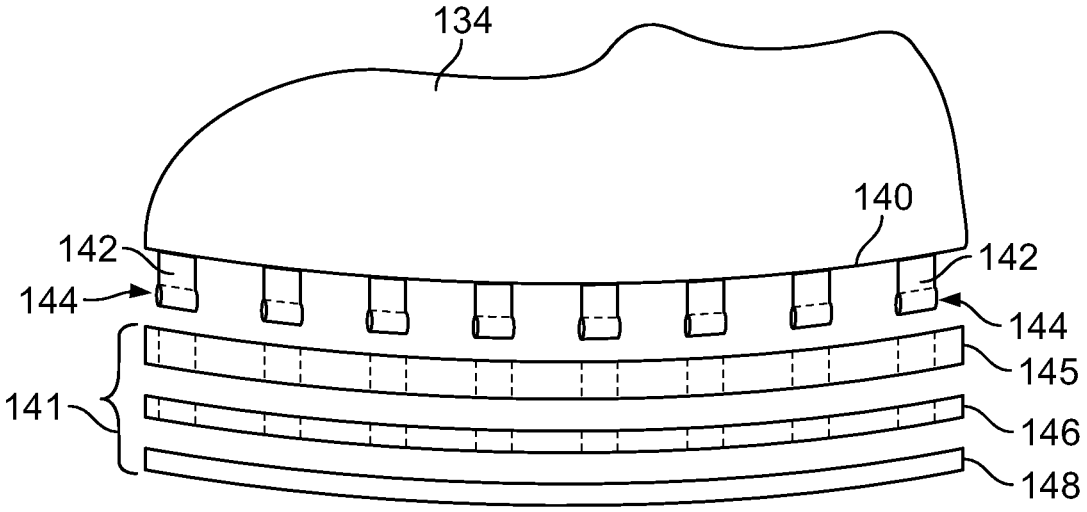
FIG. 13B is an exploded side view of the article of footwear shown in FIG.
Figure 14:
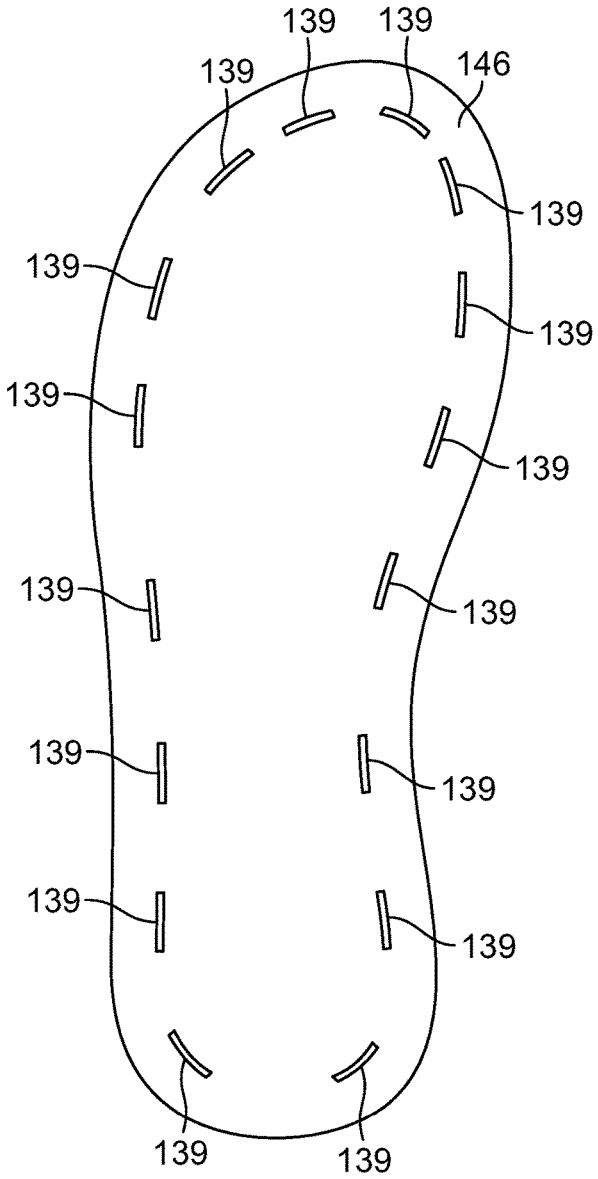
Figure 15:
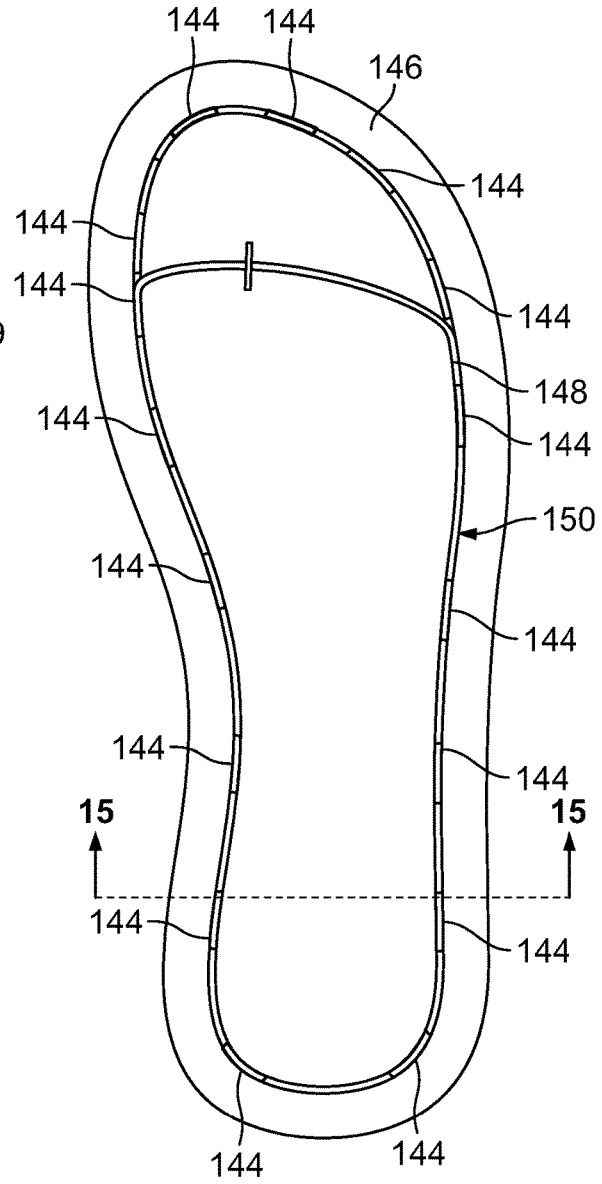
Figure 16:
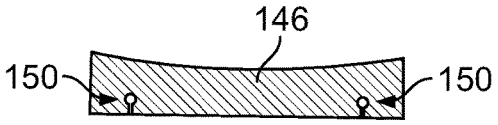
Figure 17:
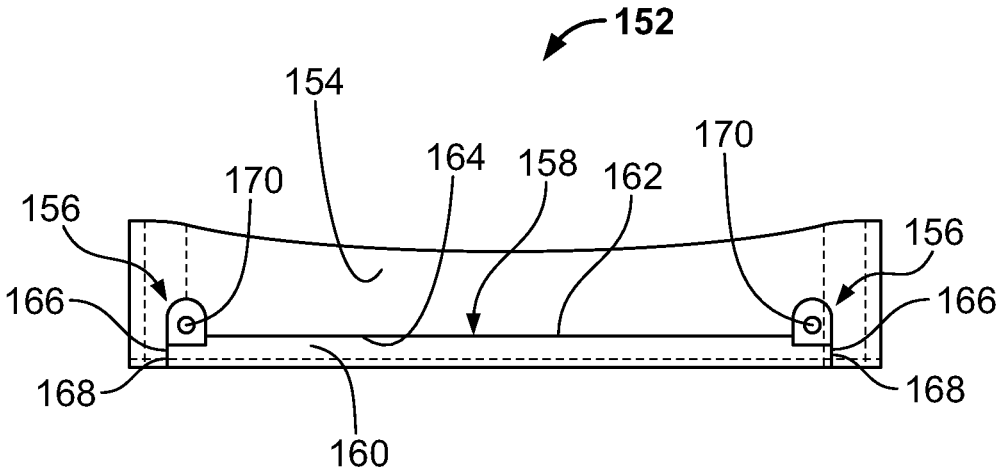
Figure 18:
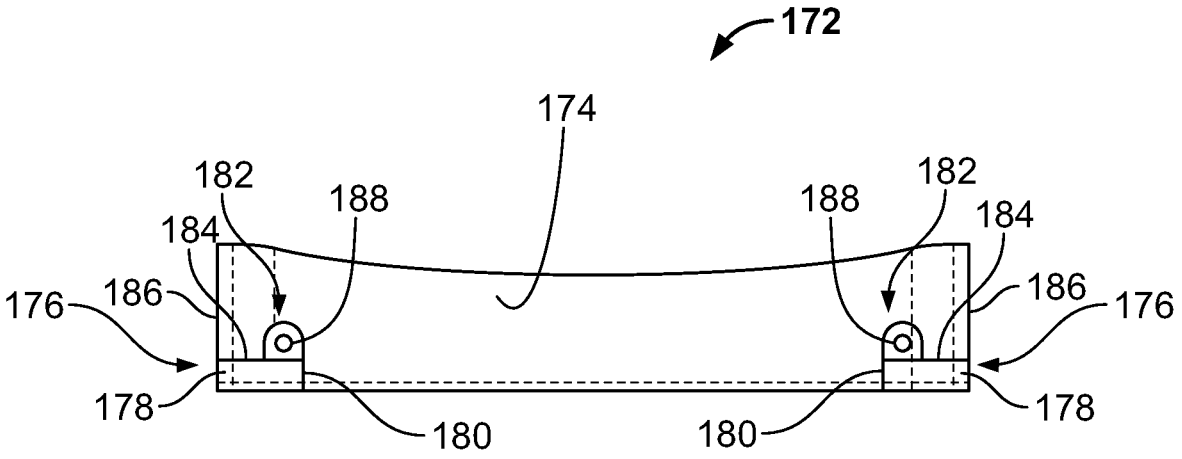
Figure 19:
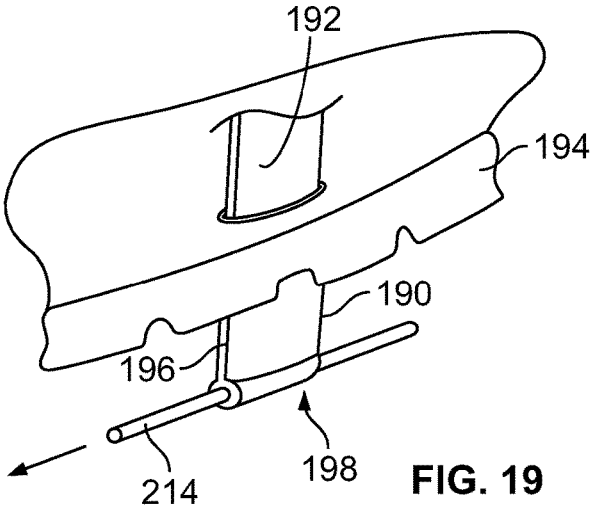
Figure 20:
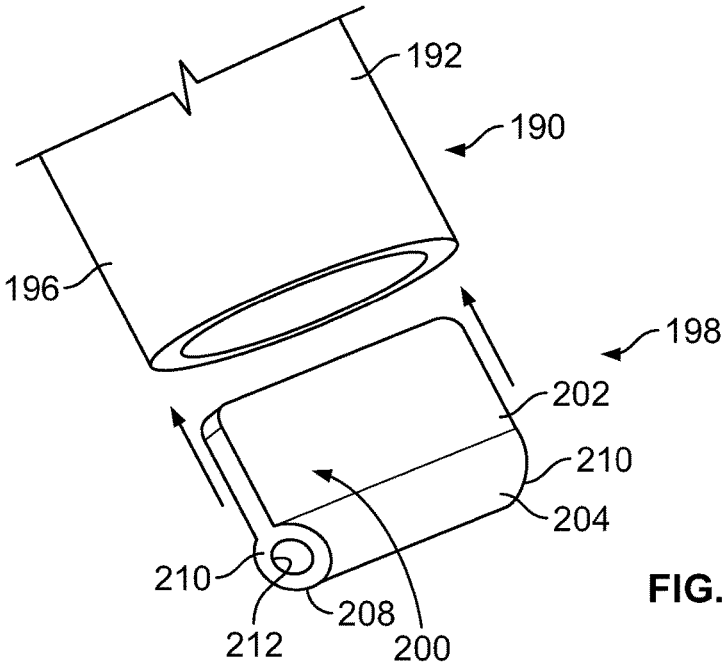
Figure 21:
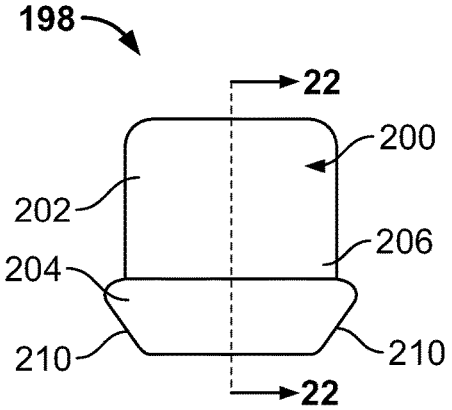
Figure 22:
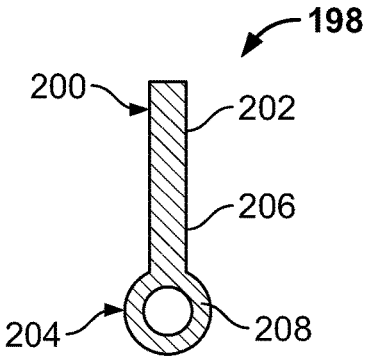
Figure 23:
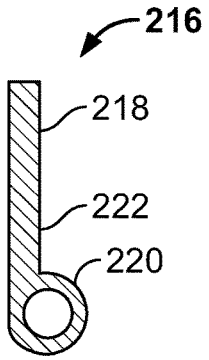

13A;

FIG. 14 is a top view of the article of footwear of FIG. 13A with the upper removed from the outsole;

FIG. 15 is a bottom view of the article of footwear of FIG. 13A;

FIG. 16 is a cross-section of the article of footwear of FIG. 15 taken along the line 15-15 and in the direction generally indicated;

FIG. 17 is a cross-section of a sole of another embodiment of the present article of footwear where the sole includes a body and an insert attached to a bottom, central portion of the body;

FIG. 18 is a cross-section of a sole of a further embodiment of the present article of footwear where the sole includes a body and an insert attached to a bottom periphery of the body;

FIG. 19 is a partial perspective view of an embodiment of a connector attached to an end of the upper where the securing member extends through the connector;

FIG. 20 is a partial exploded perspective view of the connector of FIG. 19 and an end of the upper;

FIG. 21 is a side view of the connector of FIG. 19;

FIG. 22 is a cross-section view of the connector of FIG. 21 taken substantially along the line 22-22 and in the direction generally indicated; and FIG. 23 is a cross-section view of another embodiment of the connector of FIG. 19.

Figure 24:
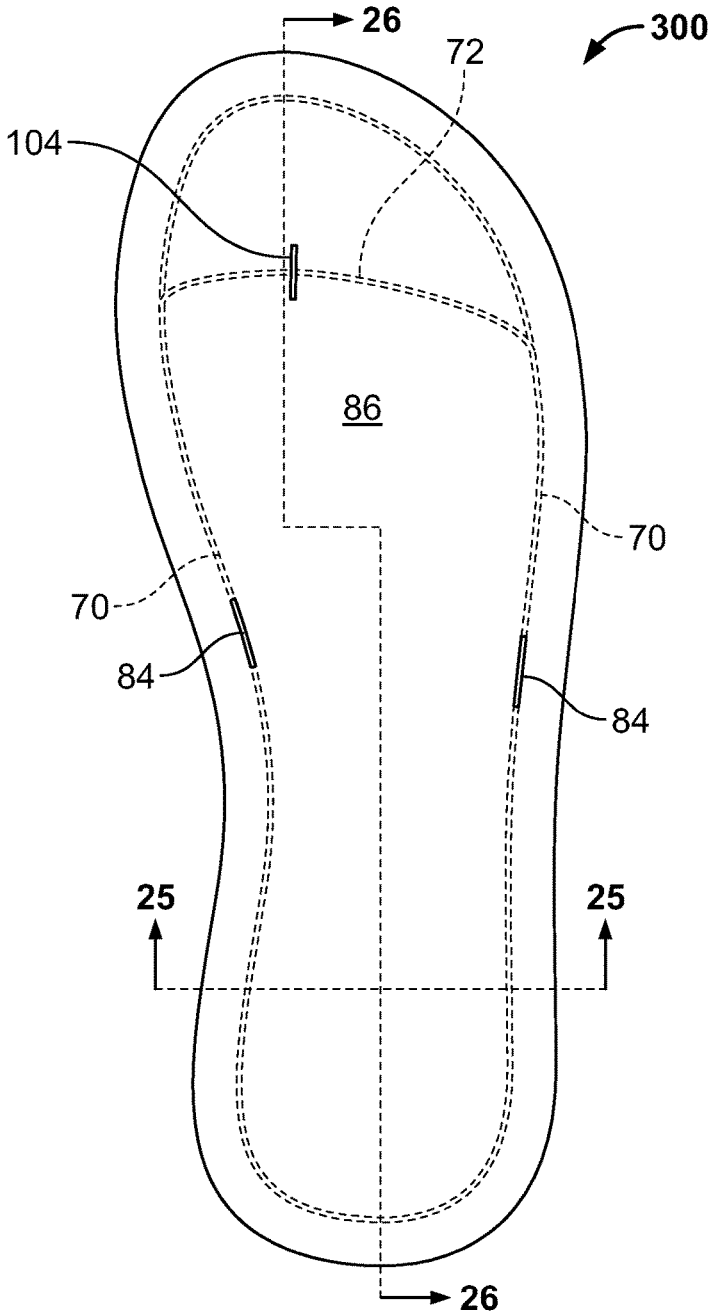
Figure 26:
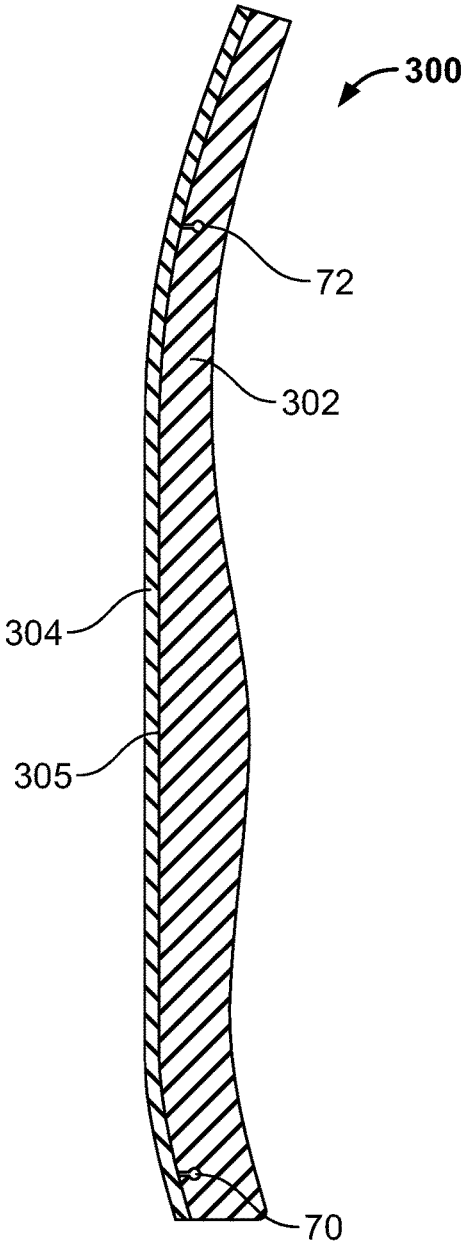
Figure 25:
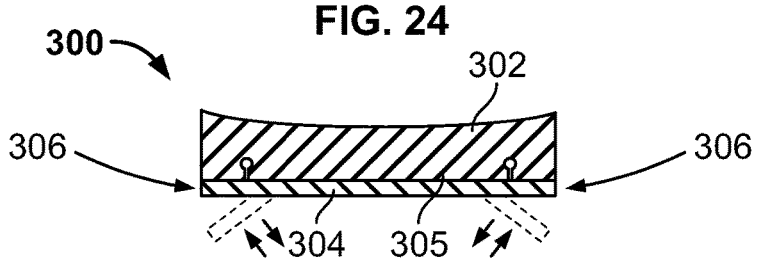
Figure 27:
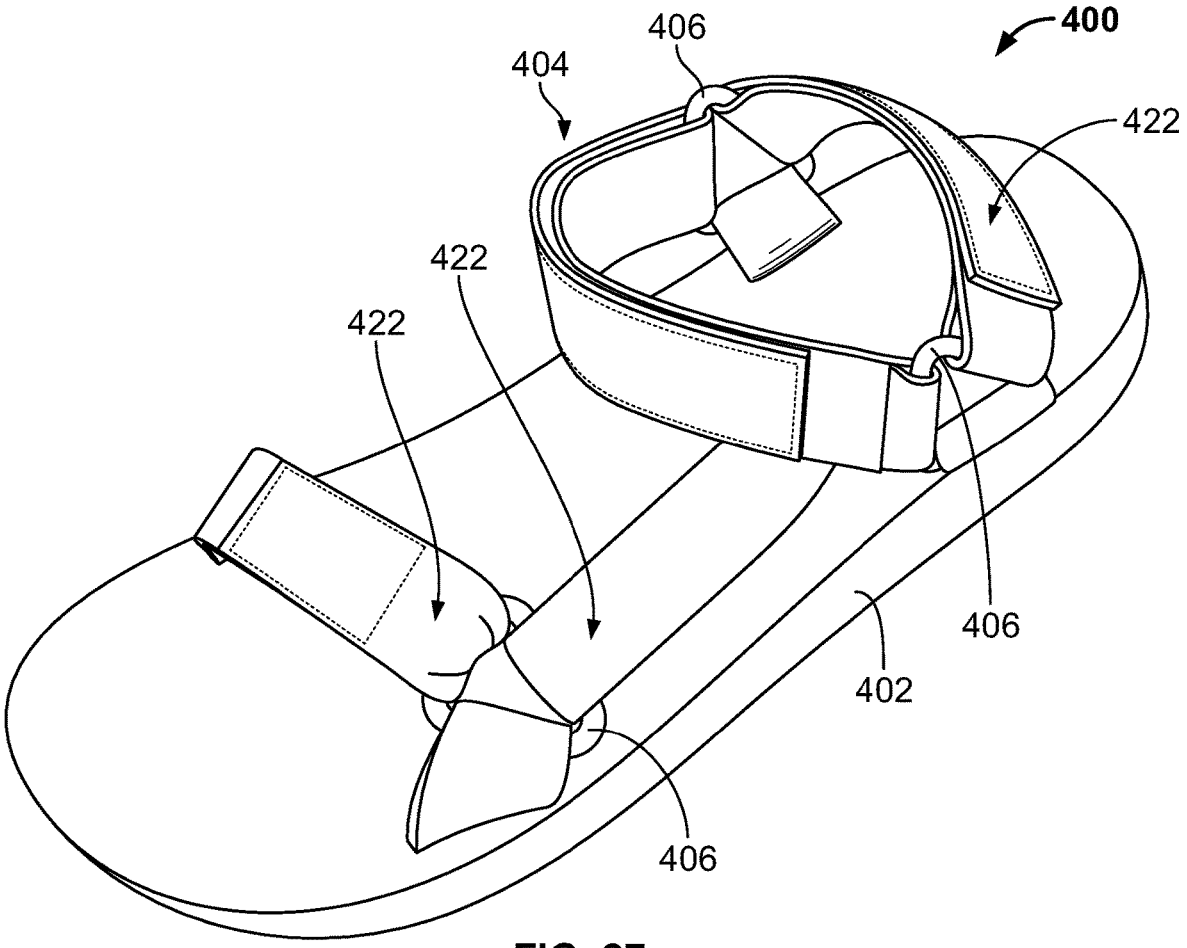
Figure 28:
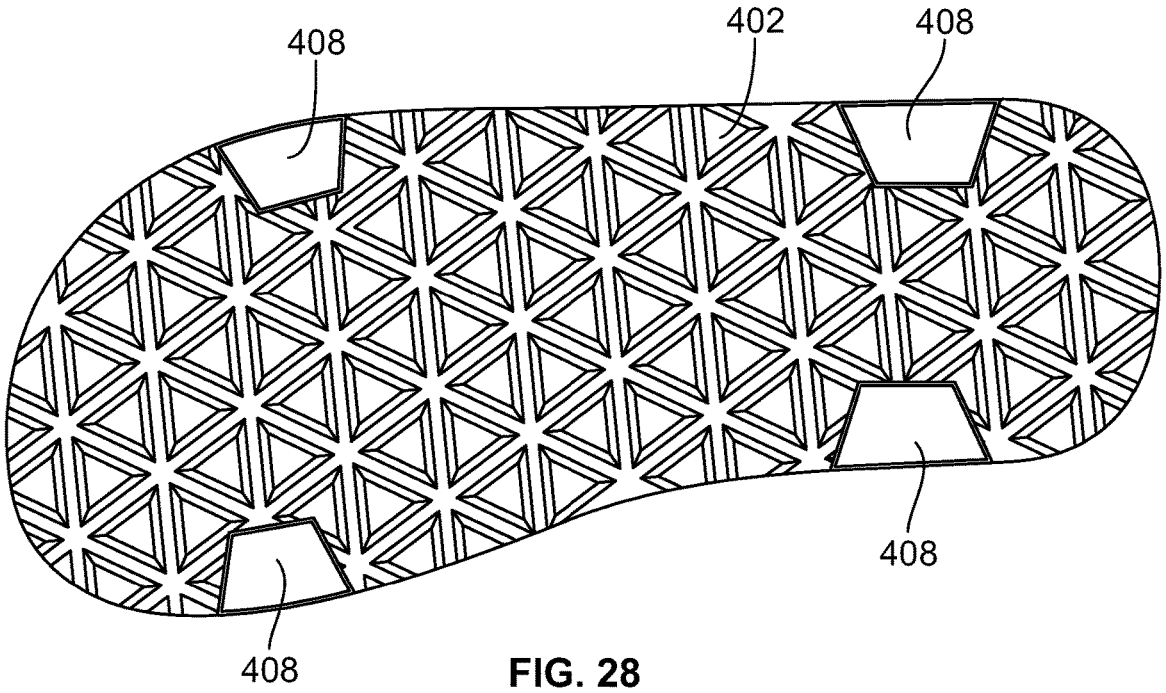
Figure 29:
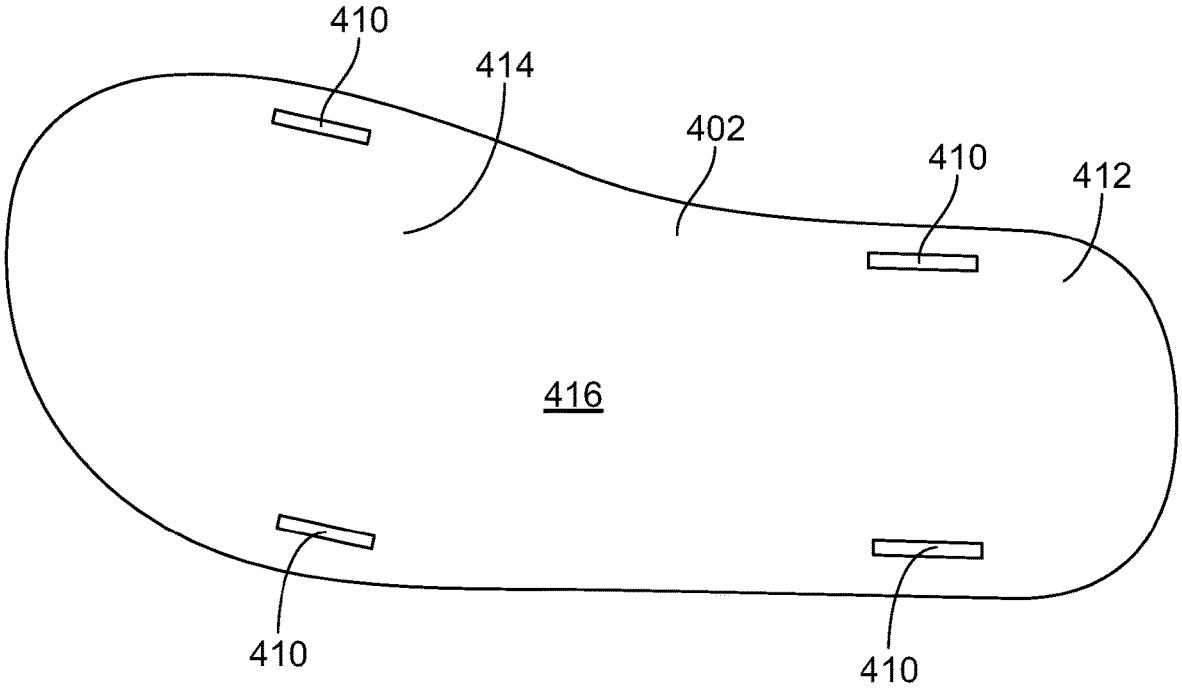
Figure 30:
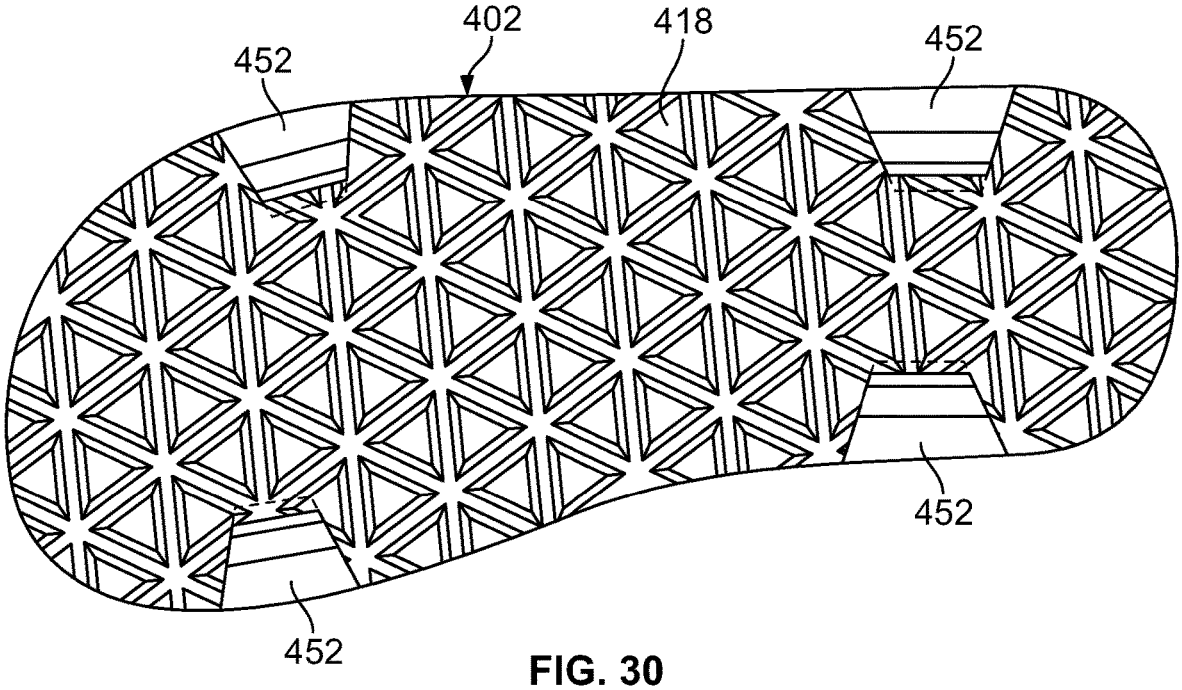
Figure 31:
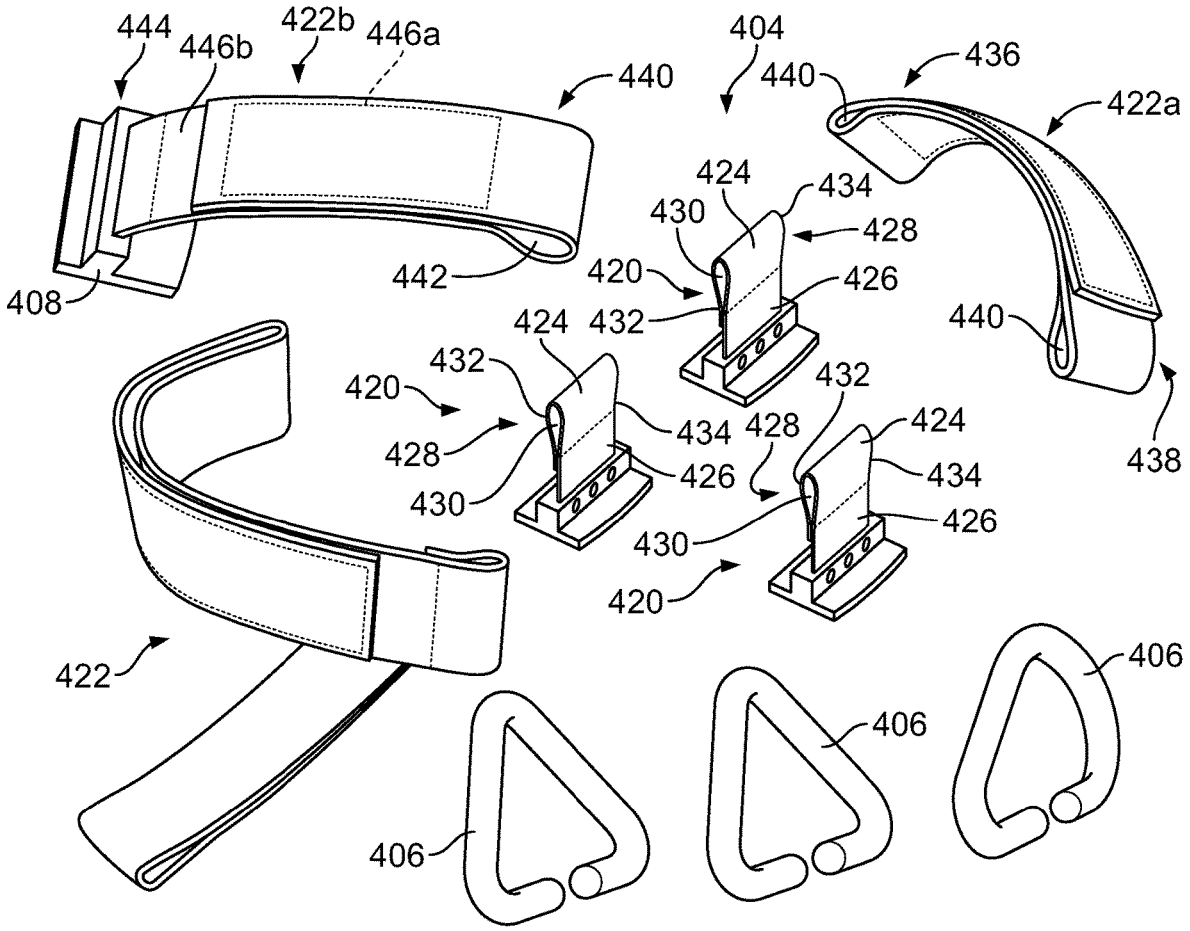
Figure 32:
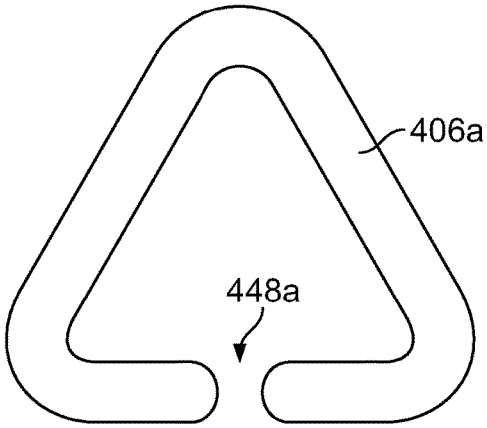
Figure 33:
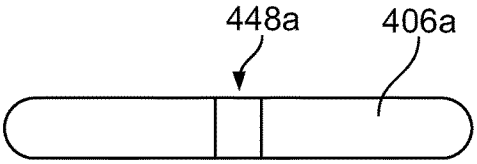
Figure 34:
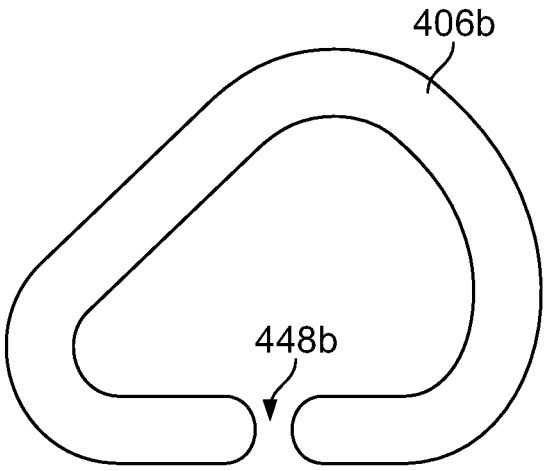
Figure 35:
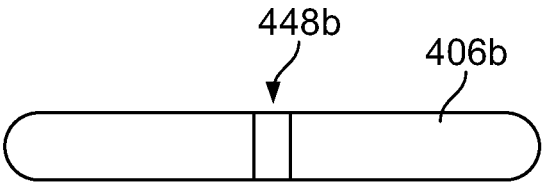
Figure 36:
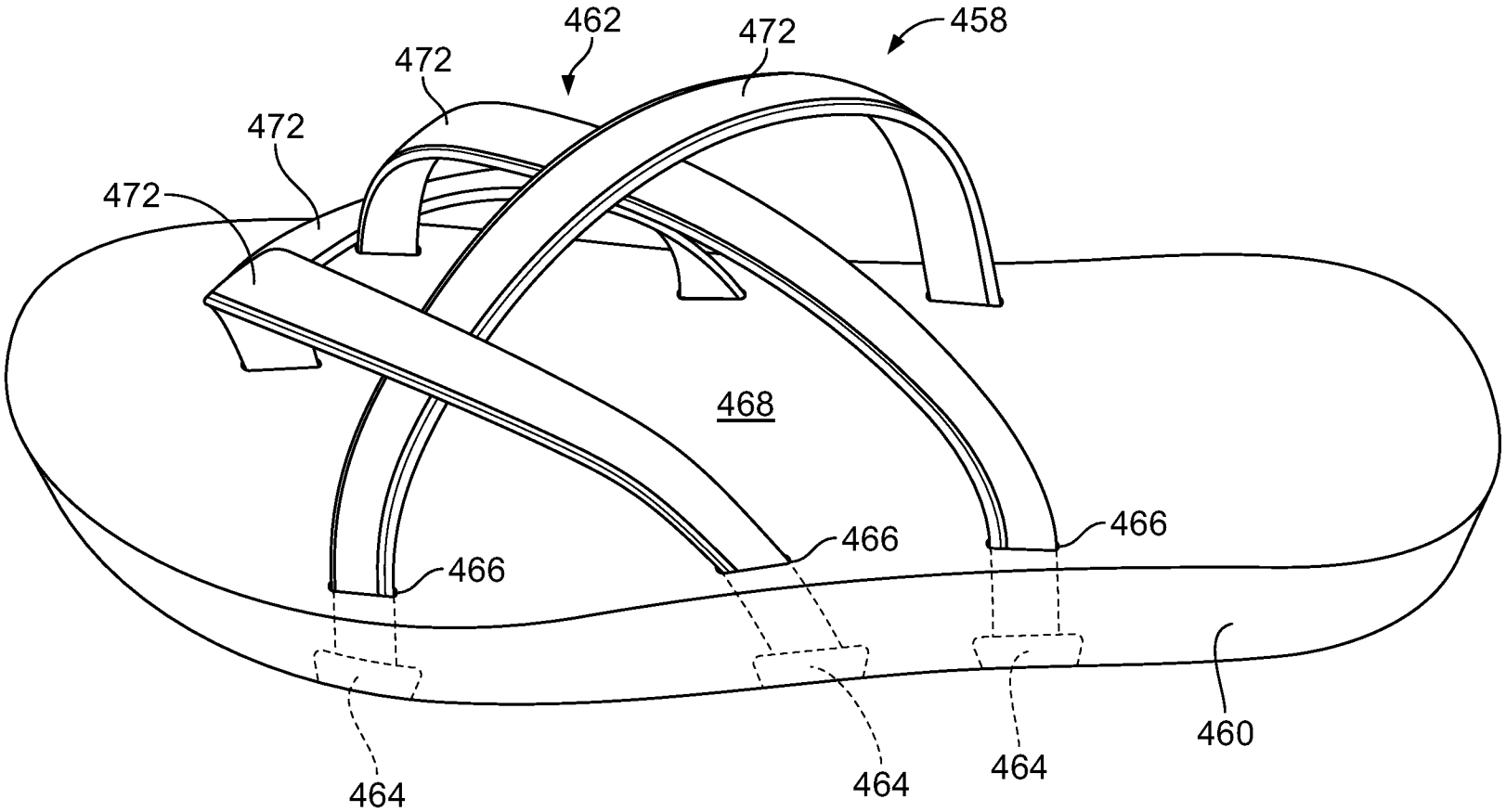
Figure 37:
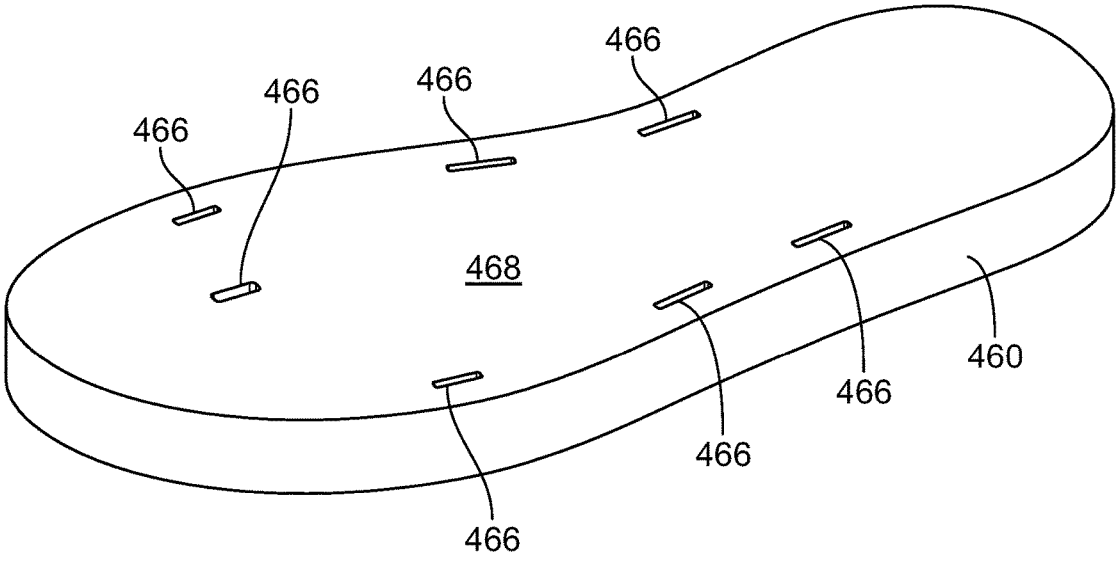
Figure 38:
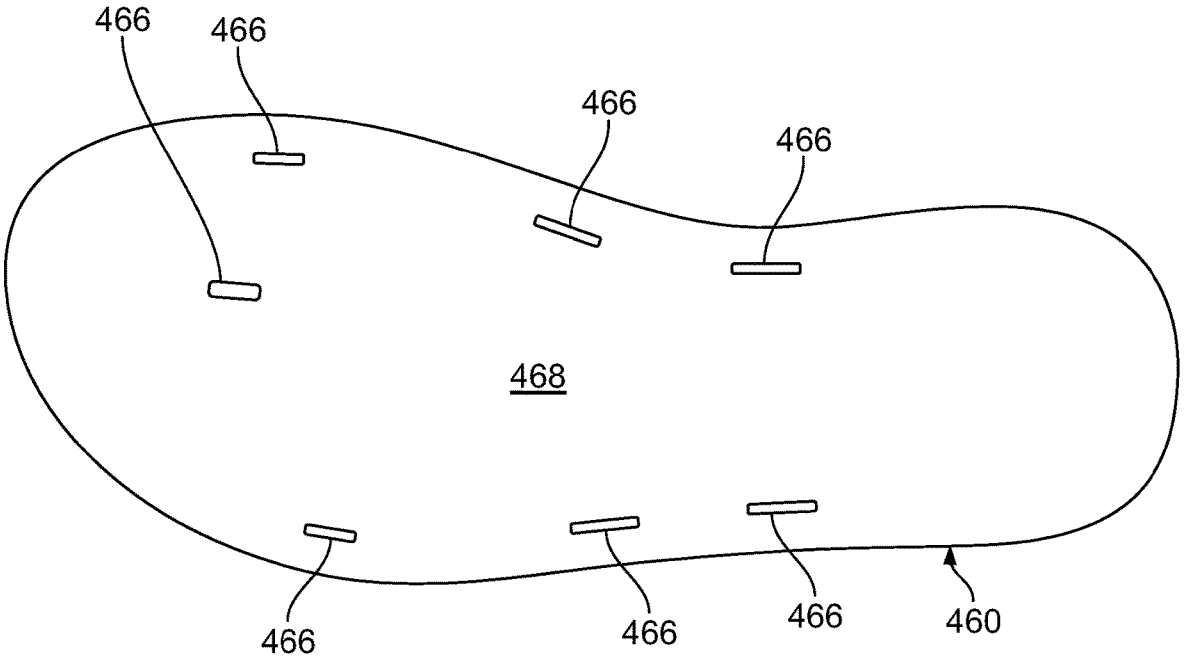
Figure 39:
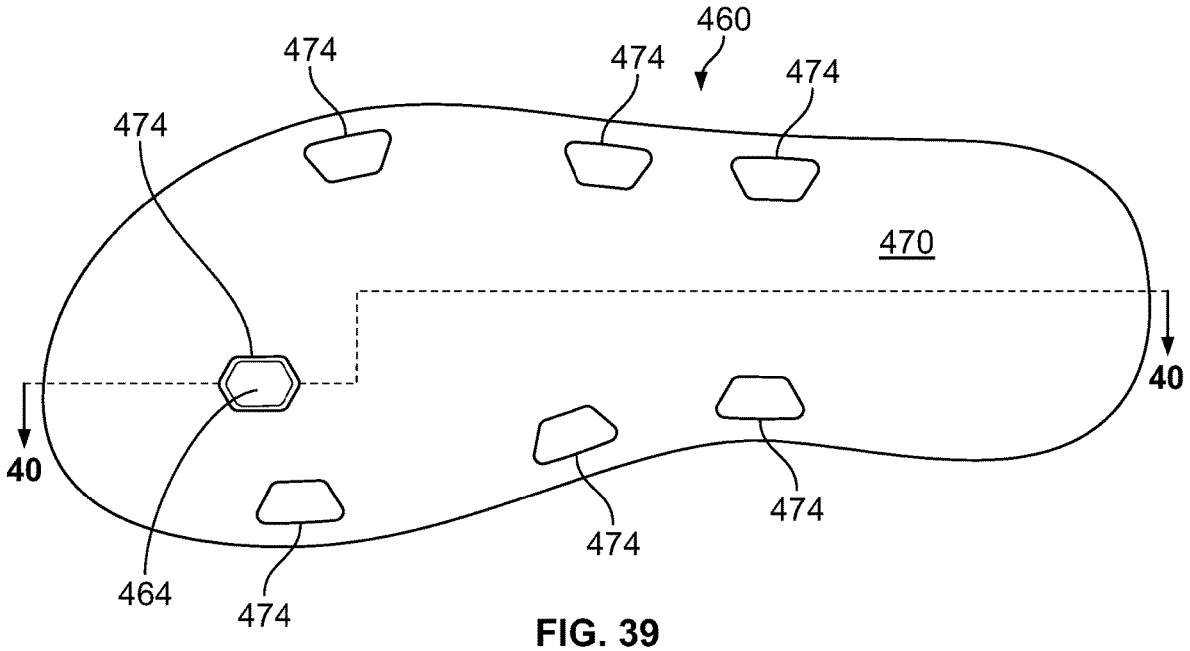
Figure 40:
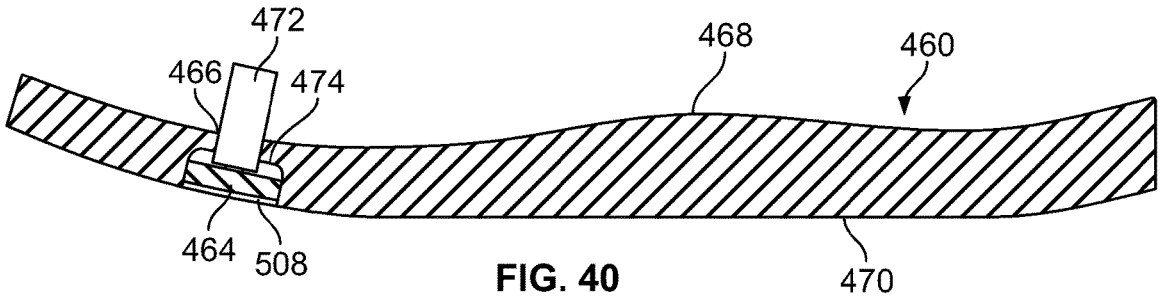
Figure 41:
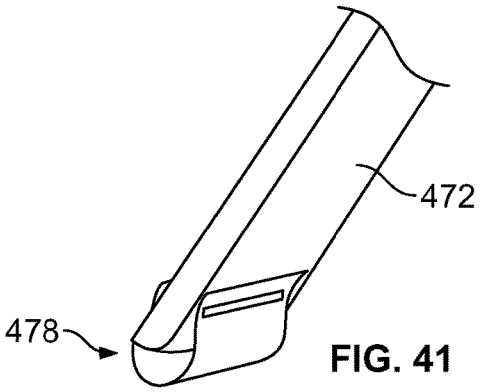
Figure 42:
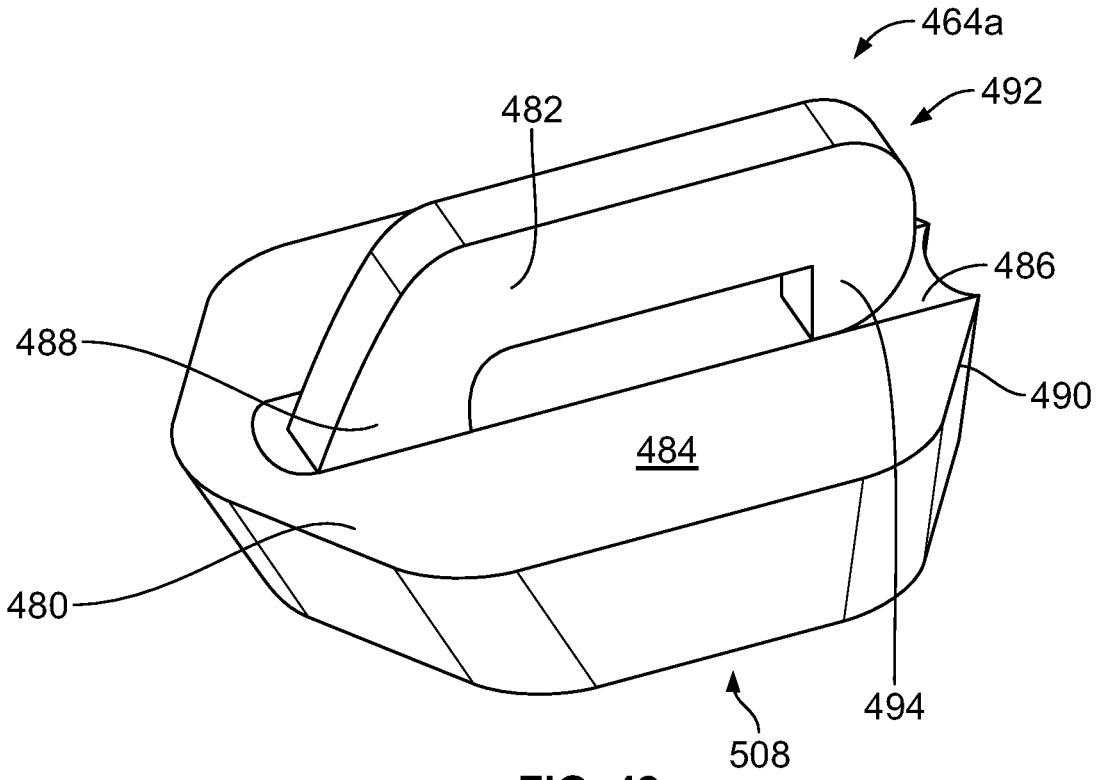
Figure 43:
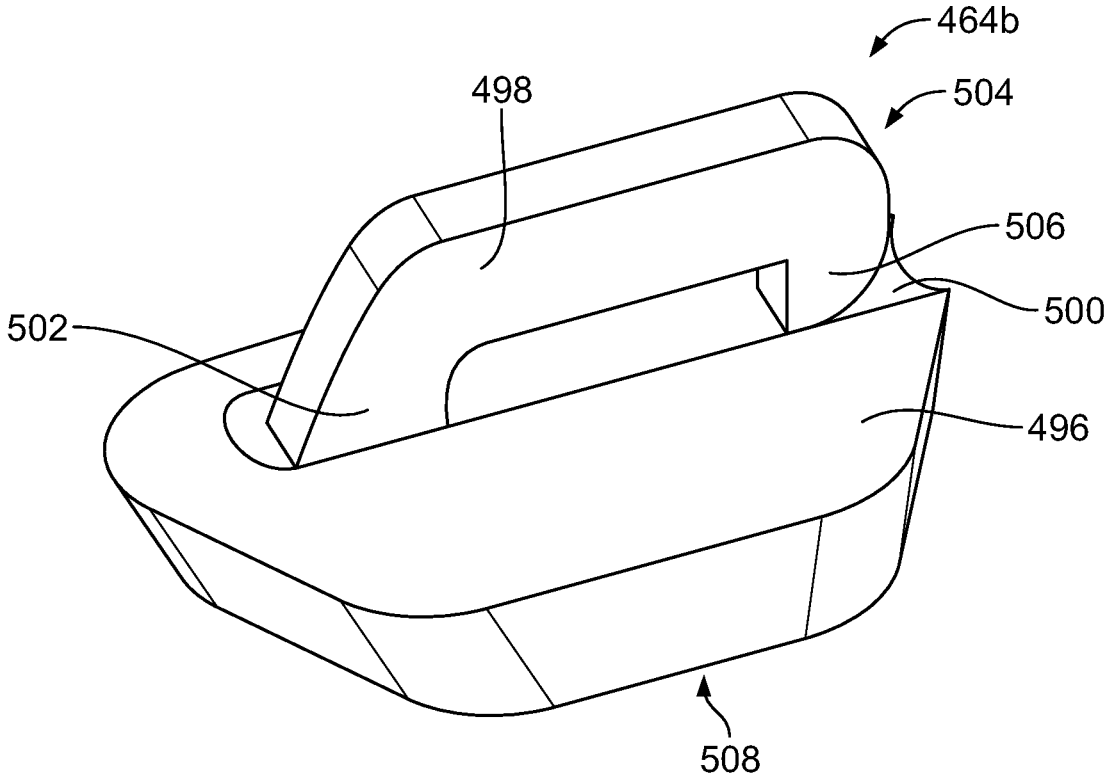
Figure 44:
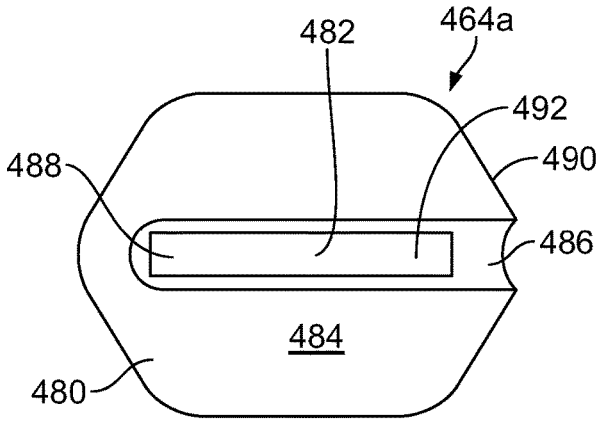
Figure 45:
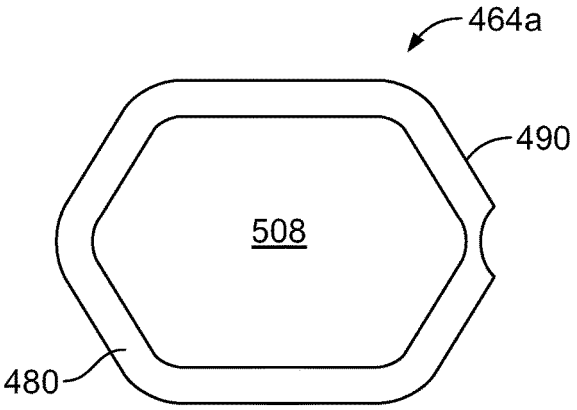
Figure 46:
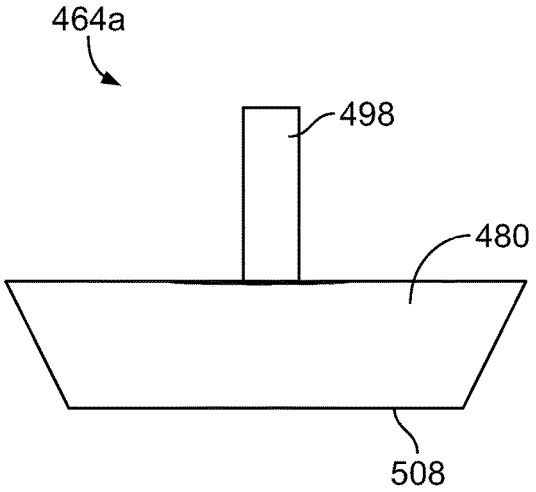
Figure 47:
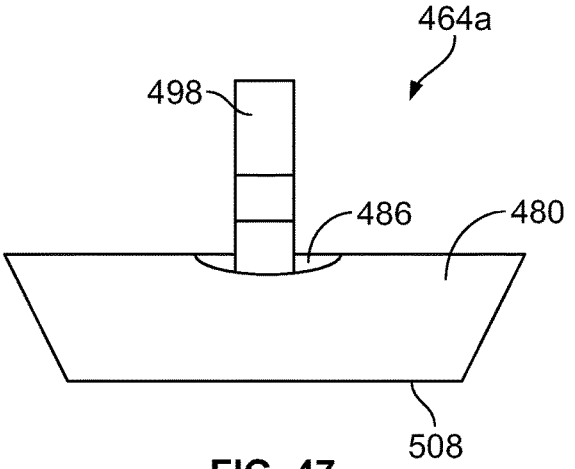
Figure 48:
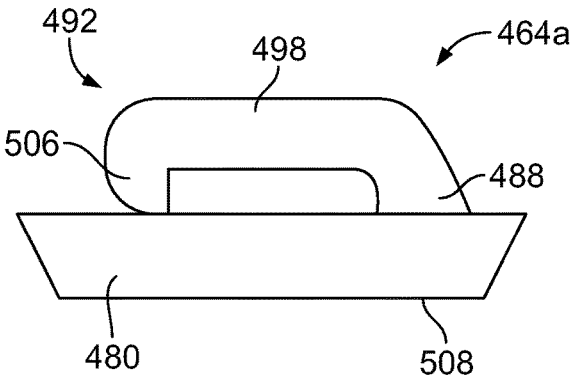
Figure 49:
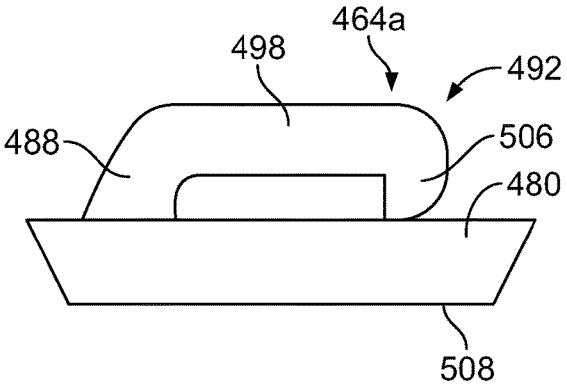
Figure 50:
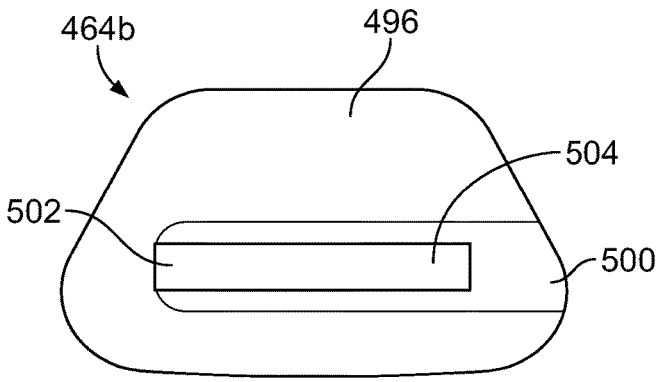
Figure 51:
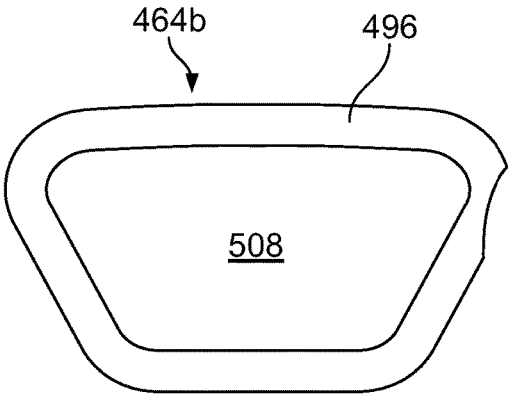
Figure 52:
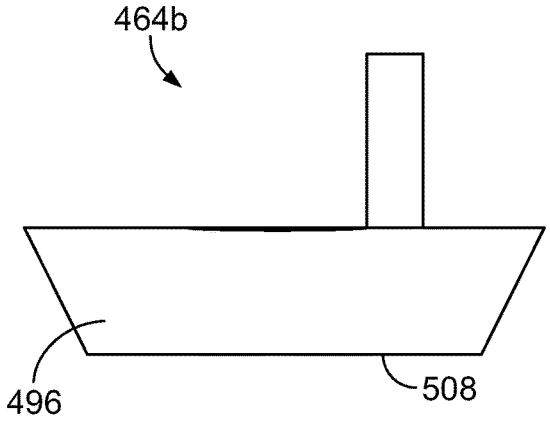
Figure 53:
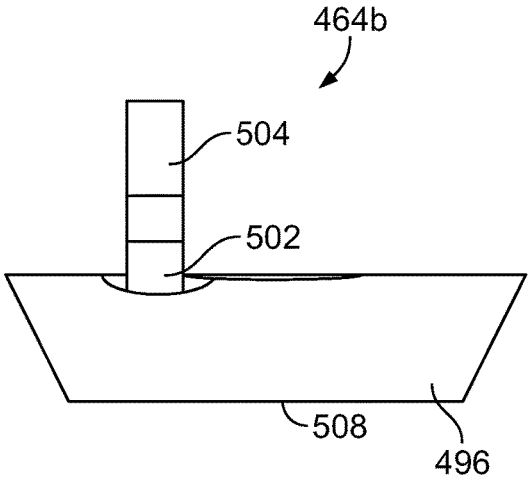
Figure 54:
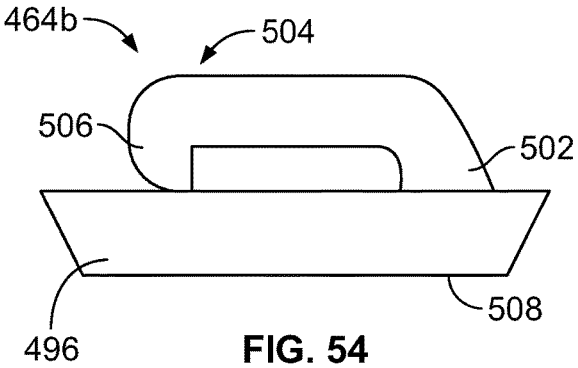

FIG. 24 is a bottom view of a sole of another embodiment of the present article of footwear where the sole includes a body and an outsole that is at least partially movable away from the body for attaching the securing member to the body;

FIG. 25 is a cross-section view of the sole of FIG. 24 taken substantially along the line 25-25 and in the direction generally indicated;

FIG. 26 is a cross-section view of the sole of FIG. 24 taken substantially along the line 26-26 and in the direction generally indicated;

FIG. 27 is a perspective view of a further embodiment of the present article of footwear;

FIG. 28 is a bottom view of the article of footwear of FIG. 27;

FIG. 29 is a top view of an outsole of the article of footwear of FIG. 27 where the straps are removed from the outsole;

FIG. 30 is a bottom view of the outsole of FIG. 29;

FIG. 31 is a perspective view of the strap assembly for the article of footwear of FIG. 27;

FIG. 32 is a front view of an embodiment of a connecting member used to connect the straps of the strap assembly of FIG. 31;

FIG. 33 is an end view of the connecting member of FIG. 32;

FIG. 34 is a front view of another embodiment of a connecting member used to connect the straps of the strap assembly of FIG. 31;

FIG. 35 is an end view of the connecting member of FIG. 34;

FIG. 36 is a perspective view of another embodiment of the present article of footwear;

FIG. 37 is a perspective view of the outsole of the article of footwear of FIG. 36;

FIG. 38 is a top view of the outsole of FIG. 37;

FIG. 39 is a bottom view of the outsole of FIG. 37;

FIG. 40 is a cross-section view of the outsole of FIG. 39 taken substantially along line 40-40 in the direction generally indicated with a securing strap and outsole connector attached to the outsole;

FIG. 41 is a fragmentary perspective view of a securing strap of the article of footwear of FIG. 36;

FIG. 42 is a perspective view of an embodiment of an outsole connector;

FIG. 43 is a perspective view of another embodiment of an outsole connector;

FIG. 44 is a top view of the outsole connector of FIG. 42;

FIG. 45 is a bottom view of the outsole connector of FIG. 42;

FIG. 46 is a front view of the outsole connector of FIG. 42;

FIG. 47 is a rear view of the outsole connector of FIG. 42;

FIG. 48 is a side view of the outsole connector of FIG. 42;

FIG. 49 is an opposing side view of the outsole connector of FIG. 42;

FIG. 50 is a top view of the outsole connector of FIG. 43;

FIG. 51 is a bottom view of the outsole connector of FIG. 43;

FIG. 52 is a front view of the outsole connector of FIG. 43;

FIG. 53 is a rear view of the outsole connector of FIG. 43;

FIG. 54 is a side view of the outsole connector of FIG. 43; and

Figure 55:
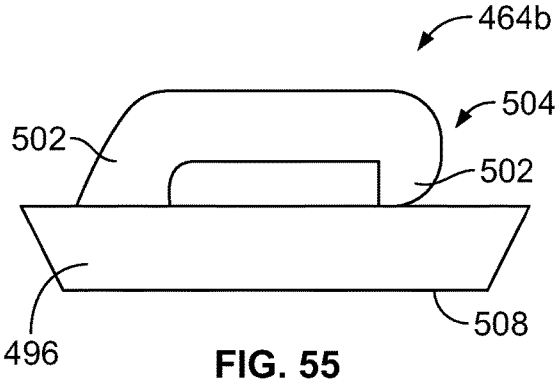

FIG. 55 is an opposing side view of the outsole connector of FIG. 43.

DETAILED DESCRIPTION

The present article of footwear includes an attachment assembly that enables an upper to be quickly and easily attached to a sole so that the different components of the article of footwear can be manufactured and assembled at different locations. Furthermore, the attachment assembly enables the upper to be removed and replaced with one or more additional uppers thereby enabling a wearer to be able to replace a worn or damaged upper or change the style and look of the article of footwear.

Referring to FIGS. 1-6, an embodiment of the present article of footwear generally indicated as 50, is a flip flop shoe or flip flop having an upper 52 and a sole such as outsole 54. It should be appreciated that the sole may include an outsole, a midsole or any combination of footwear components. In the illustrated embodiment, the upper 52 includes a toe post 56 attached generally to a forefoot portion 58 of the outsole 54 and two lateral supports 60 extending from the toe post 56 to a lateral side 62 and a medial side 64 of the outsole. As further described below, the upper 52 may have one or a plurality of the lateral supports 60 extending from the toe post 56 and/or extending between the lateral and medial sides 62, 64 of the outsole 54. A securing member 66 is removably attached to the outsole 54 and secures the upper 52 to the outsole 54.

Figure 3:
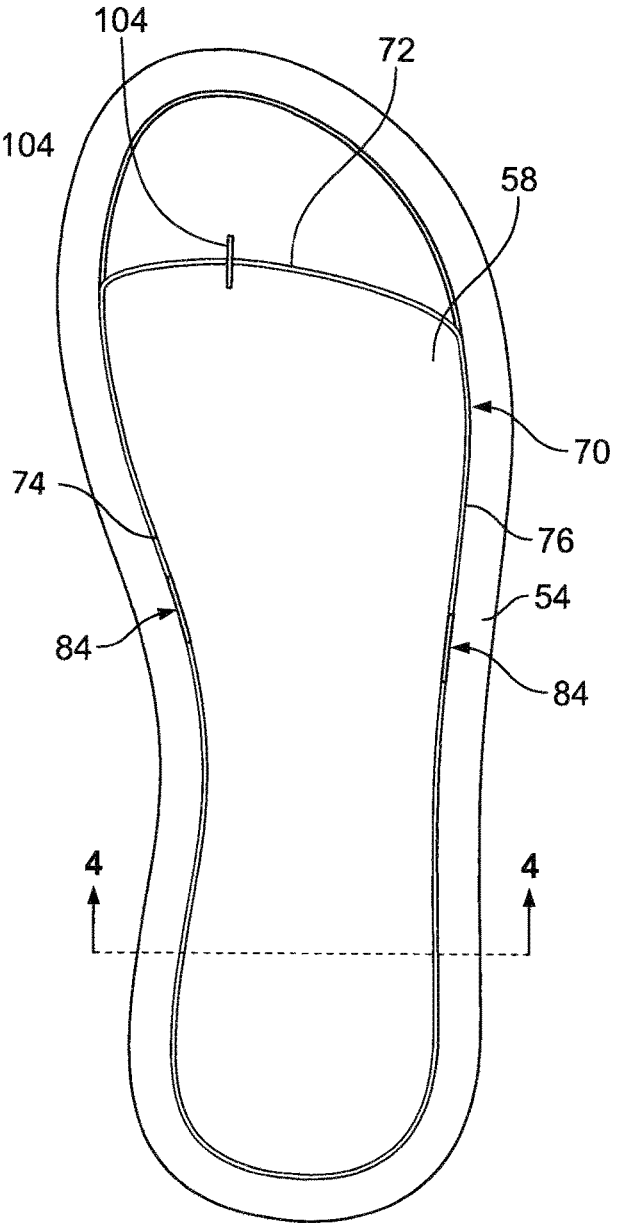
FIG. 3 is a bottom view of the article of footwear of FIG. 1.
Figure 4:
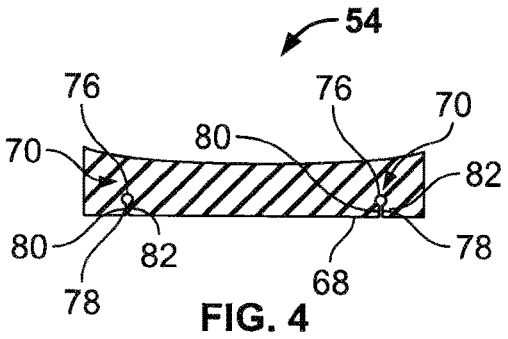
FIG. 4 is a cross-section of the article of footwear of FIG. 3 taken along the line 4-4 and in the direction generally indicated.

To attach the securing member 66 to the outsole 54, a bottom surface 68 of the outsole 54 includes a first groove or first channel 70 that extends around the periphery of the outsole (FIG. 3). A second channel 72 extends across the forefoot portion 58 of the outsole 54 between opposing sides 74, 76 of the first channel 70. As shown in FIG. 4, the first and second channels 70, 72 each have a cross-sectional shape with a top portion 76 and a bottom portion 78. In the illustrated embodiment, the top portion 76 has a generally round shape that corresponds to the cross-sectional shape of the securing member 66. It is also contemplated that the securing member 66 and the top portion 76 may have a square shape, rectangular shape or any suitable shape or combination of shapes. Furthermore, the securing member 66 and the top portion 76 may have the same general cross-sectional shape or different cross-sectional shapes. The bottom portion 78 has a narrow shape, such as a slot that extends from the top portion 76 to the bottom surface 68 of the outsole 54. Preferably, the opposing portions 80 and 82 of the outsole 54 that form the bottom portion or slot 78 of the channels 70 and 72 generally contact each other so that the first and second channels are not readily visible on the bottom surface 68 of the outsole 54.

Figure 2:
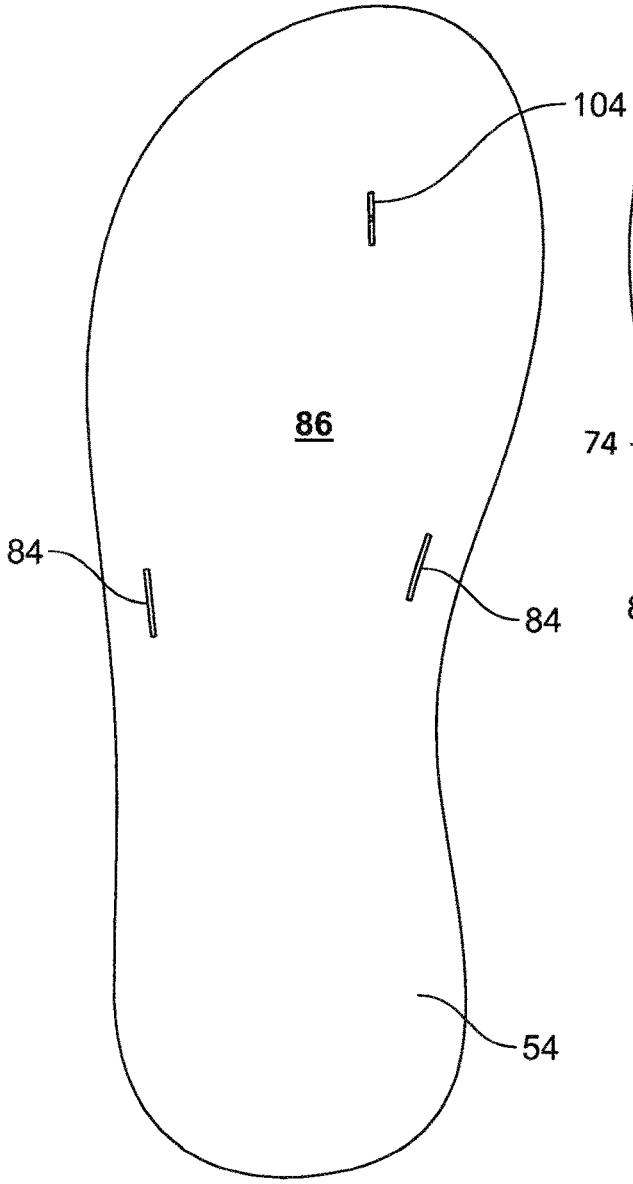
FIG. 2 is a top view of the article of footwear of FIG. 1 with the upper removed from the outsole.
Figure 5:
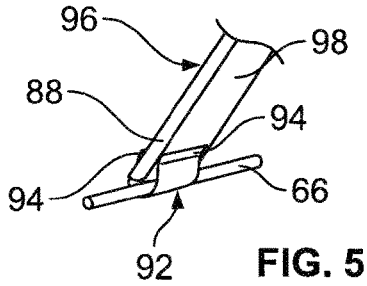
FIG. 5 is an enlarged, fragmentary view of an end of the upper of FIG. 1 where the end is attached to the securing member.

Referring now to FIGS. 2 and 5, the outsole 54 includes openings or slots 84 at designated points on a top surface 86 of the outsole 54 that are each configured to receive one of the ends 88 of the upper 52. Each slot 84 extends from the top surface 86 of the outsole 54 to the first channel 70 or the second channel 72. To connect the ends 88 of the upper 52 to the outsole 54, the ends 88 are first inserted in and moved through a respective one of the slots 84 in the outsole 54 until at least a portion of each of the ends 88 extends below the bottom surface 68 of the outsole 54.

Figure 1:
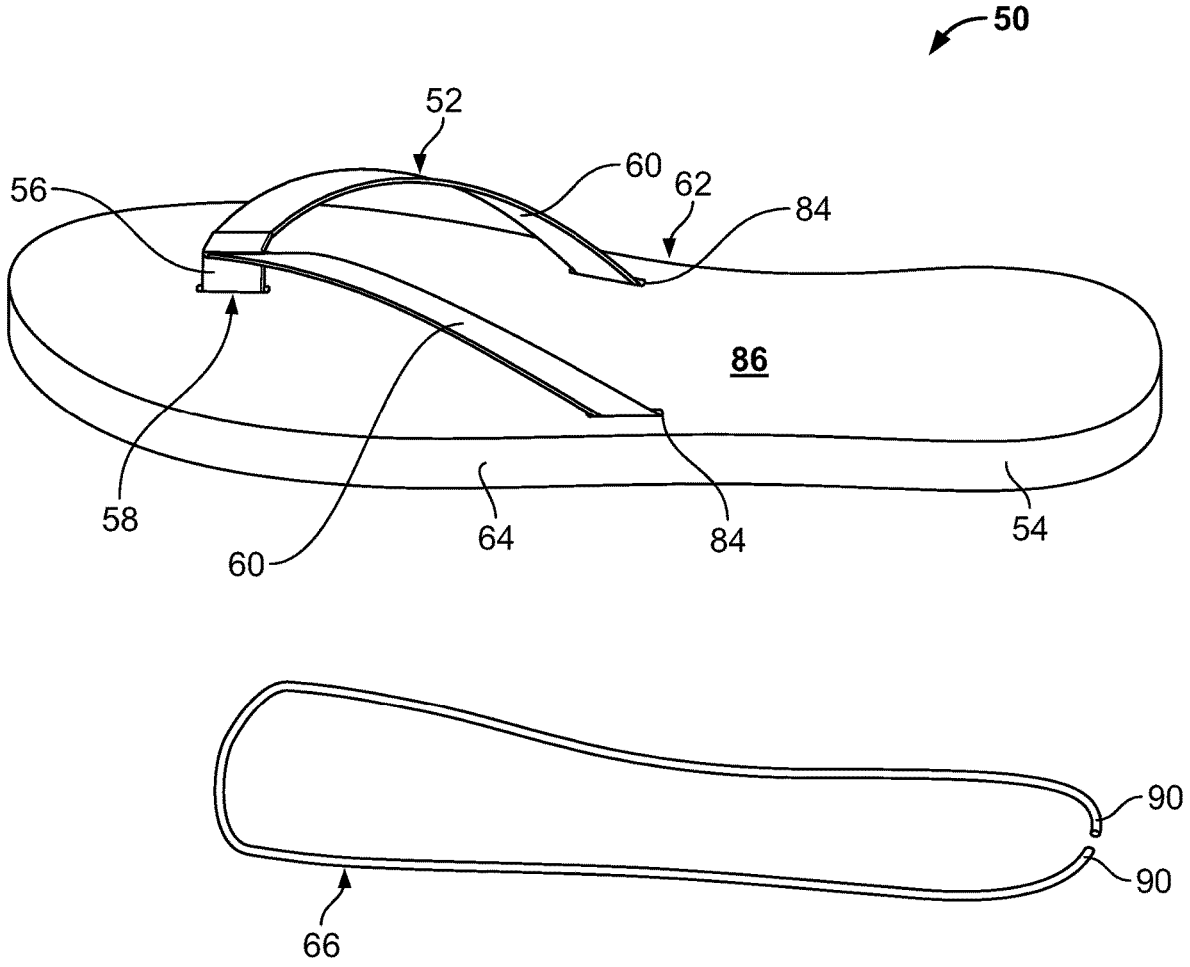
FIG. 1 is an exploded perspective view of the present article of footwear.

The securing member 66 is made of a durable, semi-rigid material such plastic, metal, nylon or other suitable material or combination of materials, and has a shape that generally corresponds to the combined shape of the first and second channels 70, 72 shown in FIG. 3. It should be appreciated that the securing member 66 may be formed with the shape of the first channel 70, the second channel 72 or any combination of the first and second channels. Also, one or a plurality of securing members 66 may be secured to the upper 52 and inserted in the first and/or second channels 70, 72 in the outsole 54. As shown in FIG. 1, the securing member 66 has connection ends 90 that are spaced apart from each other to enable the securing member 66 to be inserted or threaded through the ends 88 of the upper 52 extending through and below the bottom surface 68 of the outsole 54 as described above and shown in FIG. 5. Specifically, each of the ends 88 of the lateral supports 60 include loops 92 formed by a piece of material that is the same as or different from the material forming the upper 52. Each of the loops 92 have opposing loop ends 94 that are connected to opposing sides 96, 98 of the upper ends 88 by stitching, gluing or any other suitable connection method. The loops 92 each define a through-hole having a size that is greater than the cross-sectional size of the securing member 66 so that the securing member is easily inserted through the loops 92 attached to the upper ends 88.

In the illustrated embodiment, the end of the toe post 56 extending through the outsole 54 does not have a loop. Instead, a bottom end 102 of the toe post 56 is inserted through the toe post slot 104 and through a through-hole that is cut or formed in the toe post material at the bottom end. The securing member 66 is thereby inserted through the toe post through-hole and the loops 92 on the ends 88 of the lateral supports 60.

Figure 6:
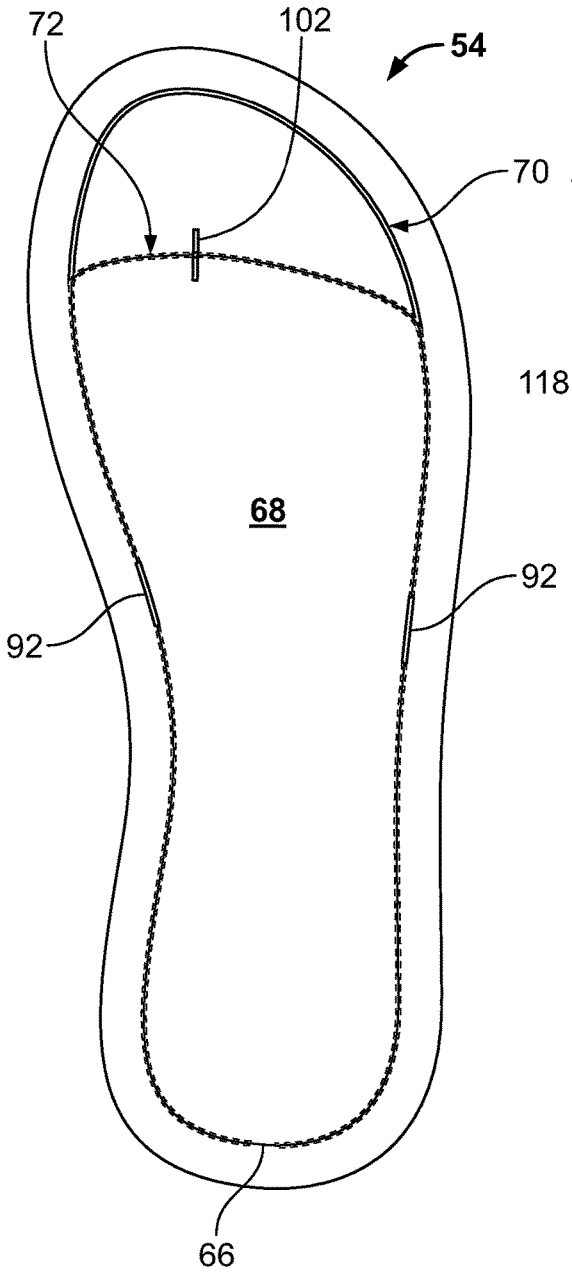
FIG. 6 is a bottom view of the article footwear of FIG. 1 with the securing member attached to the outsole.
Figure 7:
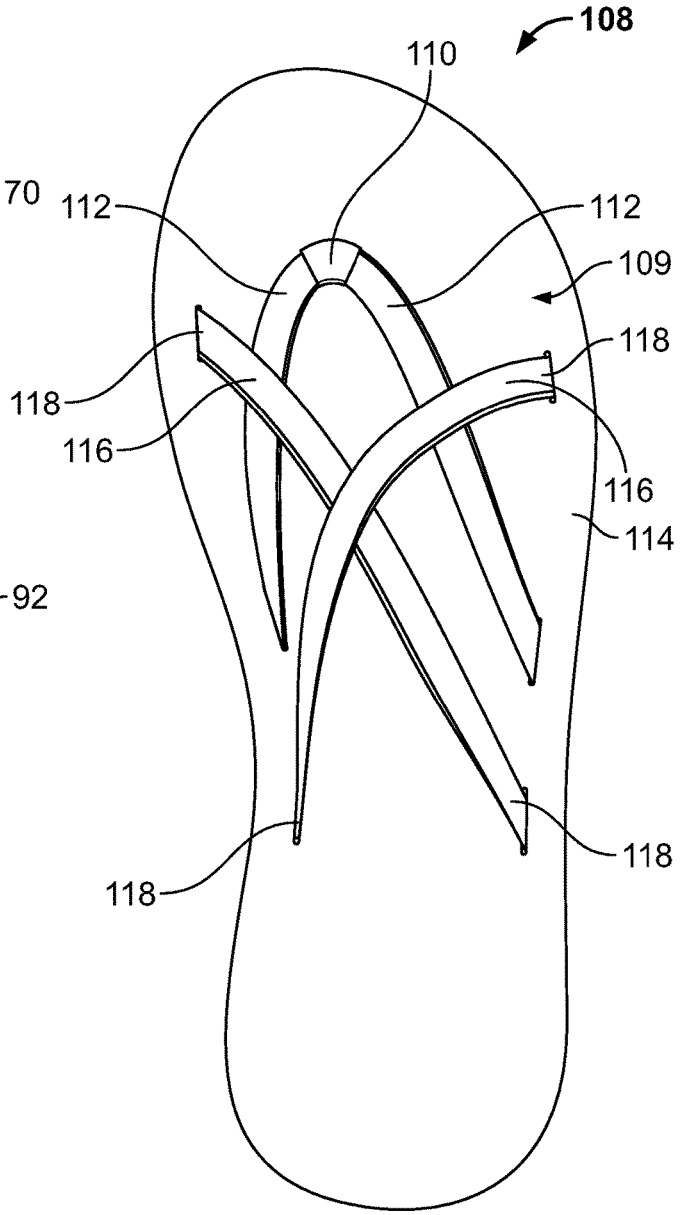
FIG. 7 is a top view of another embodiment of the present article of footwear.
Figure 8:
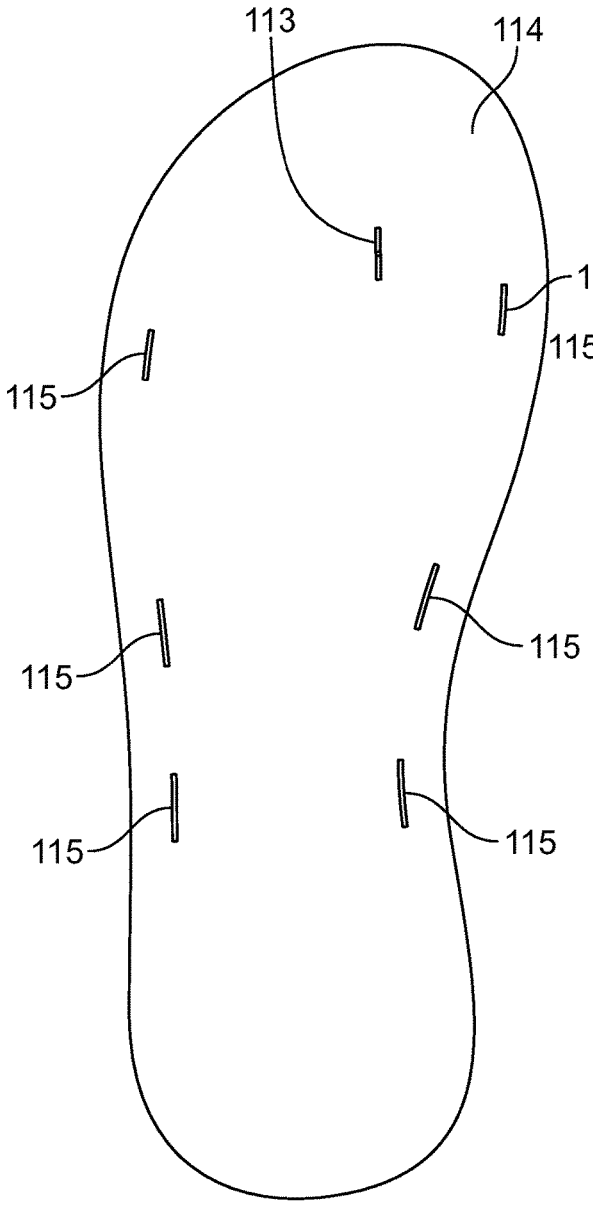
FIG. 8 is a top view of the article of footwear of FIG. 7 with the upper removed from the outsole.
Figure 9:
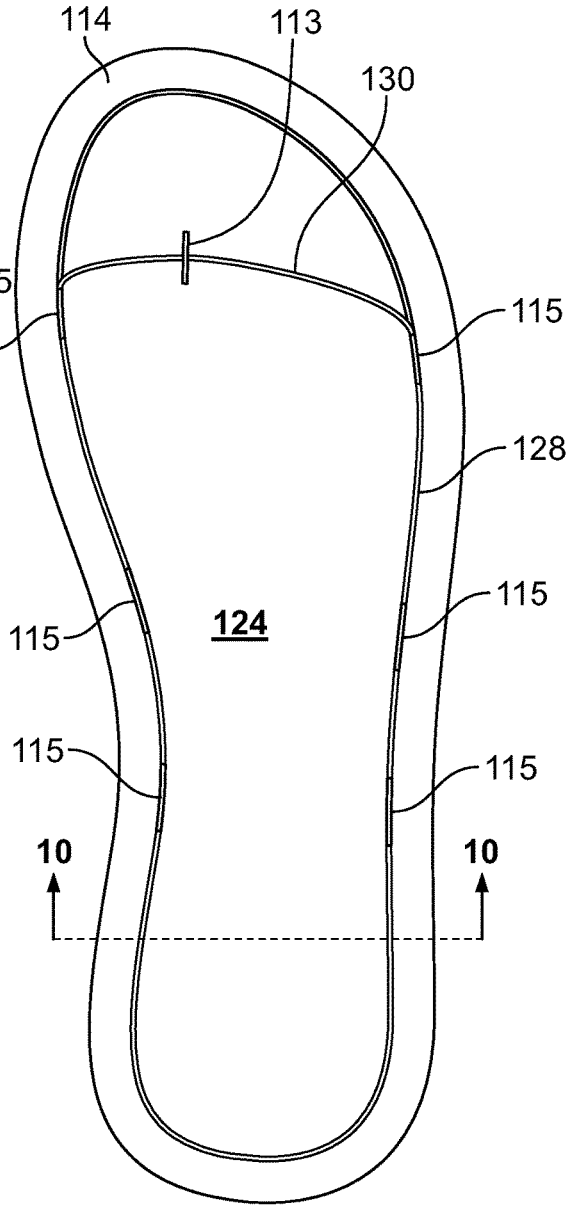
FIG. 9 is a bottom view of the article of footwear of FIG. 7.
Figure 10:
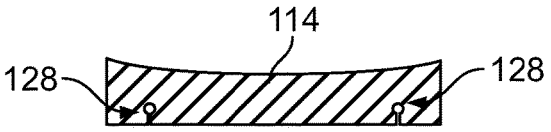
FIG. 10 is a cross-section of the article of footwear of FIG. 9 taken along the line 10-10 and in the direction generally indicated.
Figure 11:
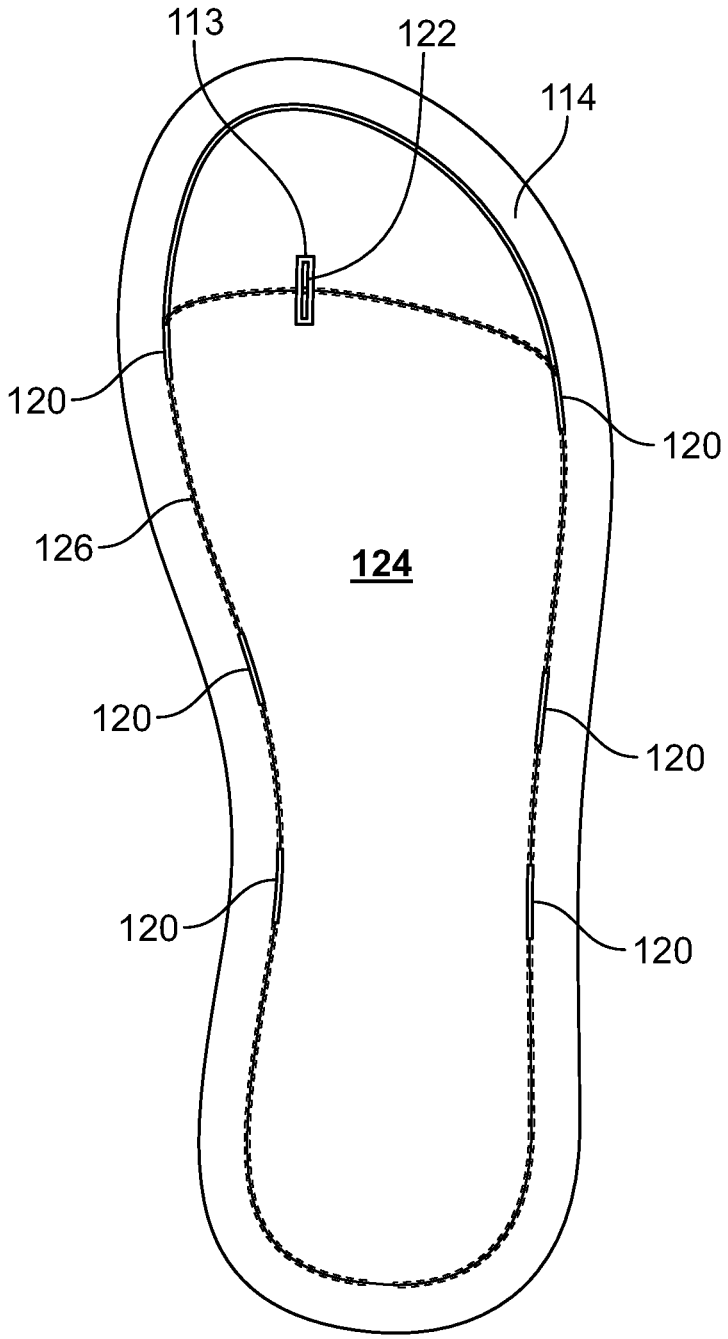
FIG. 11 is a bottom view of the article footwear of FIG. 7 with the securing member attached to the outsole.

After the loops 92 and toe post 56 are connected to the securing member 66, the securing member 66 is aligned generally with the slots 78 of the first and second channels 70, 72 and pushed upwardly through the slots 78 until the securing member 66 is within the top portion 76 of the first and second channels as shown in FIG. 6. Since the cross-sectional size of the securing member 66 is greater than the size of the bottom portion or slot 78 in each of the first and second channels 70, 72, the securing member 66 does not slip or fall out of the first and second channels. It should be appreciated that the top portion 76 of the first and second channels 70, 72 may be generally the same size as the cross-sectional shape and size of the securing member 66 or greater than the size of the securing member 66. It should also be appreciated that the material forming the securing member 66 is generally firm or rigid so that the securing member can be easily pushed into the first and second channels 70, 72 and also flexible to allow the securing member 66 to a least partially bend with the outsole 54 during use of the flip flop shoes.

The upper 52 can be removed and replaced with another upper that is the same as or different from the removed upper. For example, the upper 52 may be replaced by another upper selected from a plurality of uppers where each of the uppers in the plurality of uppers have different designs. To remove the upper 52 from the outsole 54, the outsole 54 is gradually bent while pushing on the top of the outsole against the securing member 66 to push the securing member downwardly through the slots 78 in the first and second channels 70, 72. When the entire securing member 66 is removed from the first and second channels 70, 72 and positioned below the bottom surface 68 of the outsole 54, the securing member 66 is pulled out of the loops 92 on the ends 88 of the upper 52 and the bottom end 102 of the toe post 56. Another upper can then be attached to the outsole 54 by repeating the attachment steps described above.

Referring now to FIGS. 5 and 7-11, another embodiment of the present article of footwear is illustrated and generally indicated as 108. The article of footwear 108 includes an upper 109 having a toe post 110 and two lateral supports 112 attached to opposing sides of the outsole 114. Two additional crossing lateral supports 116 are attached to the outsole 114. Each of the ends 118 of the lateral supports 116 include loops 120 that are similar to the loops 92 shown in FIG. 5 and described above. The upper 109 is attached to the outsole 114 by inserting an end 122 (FIG. 11) of the toe post 110 and the ends 118 of the lateral supports 112 respectively through opening 113 and openings 115 in the outsole 114 to a point below the bottom surface 124 of the outsole 114. The securing member 126 is threaded through the bottom end 122 of the toe post 110 and each of the loops 120 on the ends 118 of the lateral supports 116 and then pushed upwardly into the first and second channels 128, 130 as described above and shown in FIG. 11. It should be appreciated that the article of footwear 108 can be assembled to have any number and combination of the lateral supports 112 and 116. For example, the article of footwear could be assembled with only the toe post 110 and the lateral supports 112 with the additional lateral supports 116 removed to form a flip flop sandal or shoe. Alternatively, the article of footwear could be assembled with only the lateral supports 116 with the toe post 110 and associated lateral supports 112 removed.

Figure 12A:
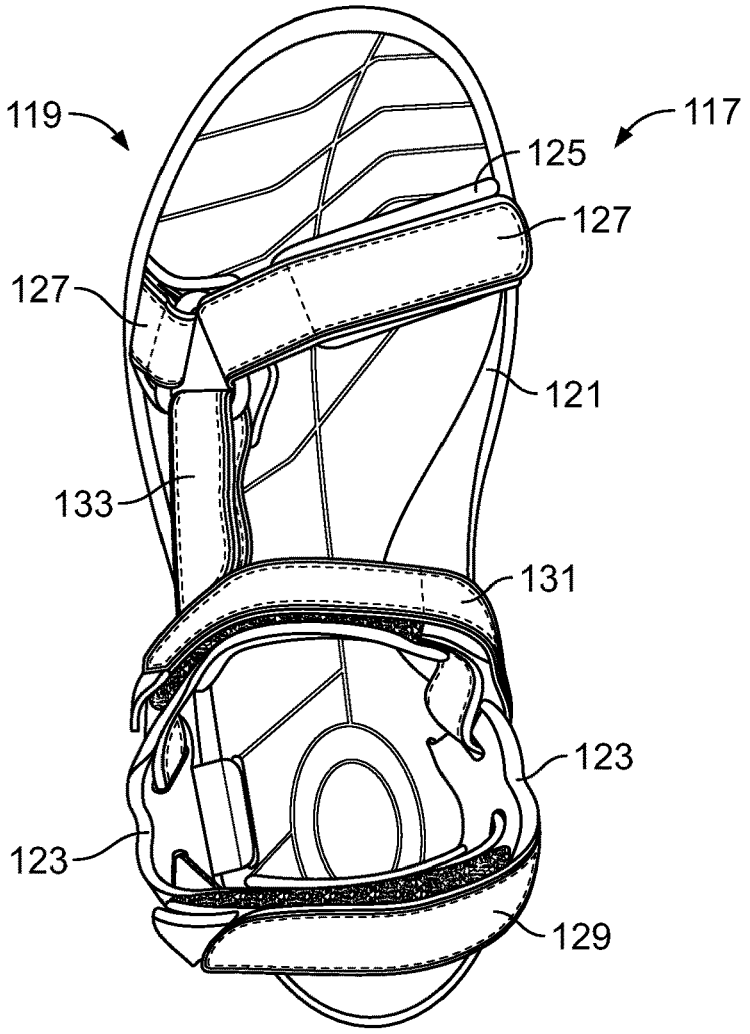
FIG. 12A is a top view of a further embodiment of the present article of footwear.
Figure 12B:
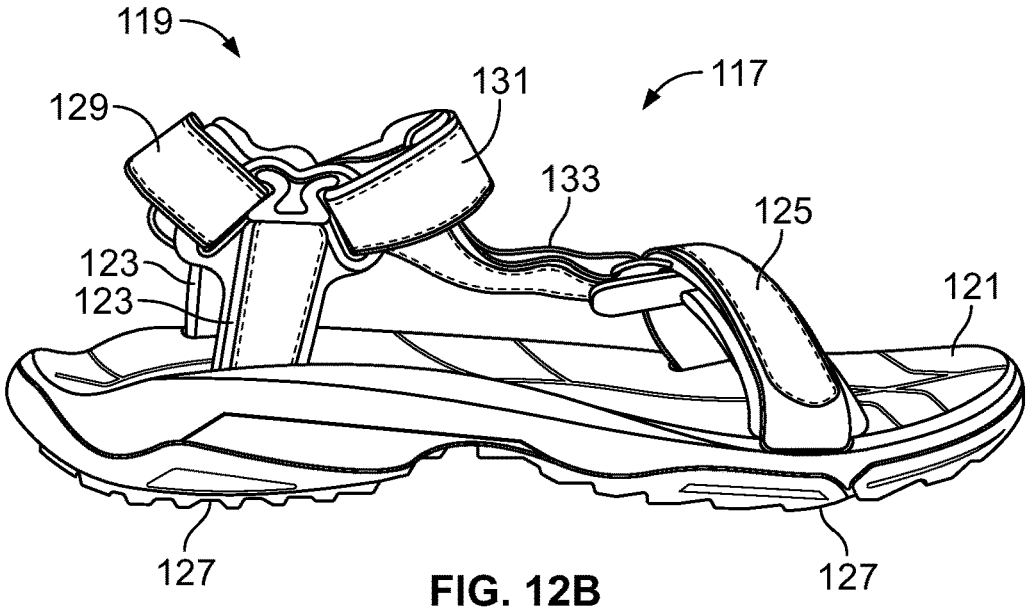
FIG. 12B is a side view of the article of footwear of FIG. 12A.

Referring now to FIGS. 12A and 12B, another embodiment of the present article of footwear 117 is shown and includes an upper 119 attached to an outsole 121 using the attachment assembly described above. In this embodiment, the upper 119 includes opposing heel posts 123 and a forefoot support strap 125 each having ends 127 extending through the outsole 121 and connected to the outsole using a securing member. A rear strap or heel strap 129 and a front strap 131 are attached to the opposing heel posts 123 and a lateral strap 133 extends between and is respectively connected to the forefoot support strap 125 and the front strap 131. It should be appreciated that any suitable combination of supports or straps may be connected to the outsole using the attachment assembly described above.

Referring now to FIGS. 5 and 13A-16, a further embodiment of the present article of footwear is illustrated and generally indicated as 132, where the article of footwear includes a closed toe upper 134 having a heel portion 136 and a foot entry opening 138. The bottom peripheral edge 140 of the upper 134 includes a plurality of supports formed as tabs 142 that each have a loop 144 similar to the loop 92 shown in FIG. 5. The tabs 140 are inserted through openings 139 in a sole 141, which includes a midsole 145 and an outsole 146, so that the securing member 148 is threaded through each of the loops 144 at the ends of the tabs 142 and pushed into the first channel or channel 150 as shown in FIG. 14 to secure the upper 134 to the outsole 146. It should be appreciated that the upper 134 may have any suitable number of tabs 142 to secure the upper 134 to the outsole 146. Also, the upper 134 may include tabs 142 that have the same width and length or different widths and/or lengths. It is also contemplated that the article of footwear 132 may be constructed with only the outsole 146.

Referring now to FIG. 17, a cross-section of another embodiment of a sole of the present article of footwear is shown where the sole includes an outsole 152 having a body portion 154 including at least one groove or channel 156 and a central recessed area 158. An insert 160 is configured to fit into the recessed area 158 in the body portion 154. Specifically, a top surface 162 of the insert 160 is cemented or glued to a bottom surface 164 of the body portion 154 of the outsole 152 to attach the insert 160 to the body portion 154. The opposing sides 166 of the insert 160 do not include glue or adhesive to enable a slot 168 to be formed between the body portion 154 and the insert 160 on each side of the insert. In this way, the ends of an upper can be inserted through the outsole 152 between the body portion 154 and the insert 160 and attached to a securing member 170. The securing member 170 is then pushed upwardly through the slots 168 and into the channel 156 formed in the body portion 154 to secure an upper to the outsole 152. The upper can be removed from the outsole 152 by pushing the securing member 170 out through the slots 168 between the body portion 154 and the insert 160 as described above.

Referring now to FIG. 18, a cross-section of a further embodiment of a sole of the present article of footwear is shown where the sole includes an outsole 172 having a body portion 174 with a peripheral recessed area 176 and one or more inserts 178 configured to fit into and be attached to the recessed area 176. In this embodiment, inner surfaces 180 of the insert 178 are cemented or glued to the body portion 174 to attach the insert 178 to the body portion 174. The body portion 174 includes at least one channel 182. A slot 184 is formed between the body portion 174 and the insert 178 where the slot extends from an outer surface 186 of the outsole 172 to the channel 182. The securing member 188 is configured to be aligned with and moved through the slots 184 to be seated in the at least one channel 182 to secure the securing member 188 and thereby an upper to the outsole 172. The upper is removed from the outsole 172 by pushing the securing member 188 out through the slots 184. It should be appreciated that the body portion 174 and the insert 178 may be any suitable size and shape.

Referring now to FIGS. 19-23, at least one and preferably each end 190 of the supports or straps 192 of an upper are attached to the outsole 194 where each end 190 is made with one or more pieces of material 196 to form a tube configured to receive a connector 198 inserted into the tube and secured to the end 190 of the support or strap 192 by glue, stitching or other suitable connection method. The connector 198 includes an integrally formed body 200 having a first part 202 that is generally planar and a second part 204 centrally positioned and connected to an end 206 of the first part 202 where the second part 204 forms a circular tube or cylinder 208 with inwardly beveled ends 210. As shown in FIGS. 20 and 21, the tube 208 defines a through-hole 212 configured to receive a securing member 214 as described above. FIG. 19 shows that the securing member 214 is inserted through the through-hole 212 of the tube 208 of the connector 198 to secure the ends 190 of the supports or straps to the outsole 194. In another embodiment, a connector 216, shown in FIG. 23, has a first planar part 218 and a second part 220 that is circular or round and attached to the first part on one side or one surface 222 of the first part. It should be appreciated that the connector may be any suitable size and have any suitable shape.

Referring now to FIGS. 24-26, another embodiment of a sole of the present article footwear is shown and generally indicated as 300, where the sole 300 includes a body 302 and a bottom member 304 attached to the body where at least a portion of the bottom member 304 is movable away from the body for attaching a securing member. As shown in dashed lines in FIG. 24, the body 302 includes grooves or channels 70, 72 configured to receive a securing member, such as securing member 66 shown in FIG. 1. The securing member has a similar size and shape to the channels 70, 72 such that the securing member is aligned with and inserted into the channels and is thereby attached to or secured to the body 302. In this embodiment, the bottom member 304 is configured to have generally the same size and shape as the bottom surface 305 of the body 302 such that it covers the bottom surface. The bottom member 304 is attached to the bottom surface 305 of the body 302 by attaching the central or middle part of the bottom member to the bottom surface 305 using an adhesive, stitching or other suitable connection method. As shown in FIG. 25, the outer ends or outer edges 306 of the bottom member 304 are not secured to the body 302 so that the outer edges may be flexed or moved towards and away from the body as indicated by the arrows.

Referring to FIG. 26, the bottom member 304, and more specifically, the outer edges 306, cover the channels 70, 72 in the body 302 such that the channels are not visible when the outer edges are in contact with the bottom surface 305 of the body. As such, the bottom member 304 helps to further secure the securing member in the channels 70, 72, and also covers and conceals the channels to enhance the aesthetic appearance of the bottom of the sole 300 as well as inhibit dirt and other debris from entering the channels 70, 72. It should be appreciated that the bottom member 304 and the body 302 may be made of the same material or different materials. Furthermore, the bottom member 304 is preferably made of a resilient, flexible material so that the outer edges 306 of the bottom member 304 can be easily moved away from the body 302, and then spring back or move back in contact with the body, while being durable enough to withstand repeated contact and friction with the ground.

In use, the securing member is inserted in or removed from the channels 70, 72 by folding back or moving the outer edges 306 of the bottom member away from the body 302 and thereby expose the channels 70, 72 so that a user can insert the securing member in the channels or grab and pull out the securing member from the channels. It should be appreciated that the securing member may be made of any suitable material that is flexible and rigid enough to be easily inserted in and removed from the channels as described above. Similar to the above embodiments, the straps or upper of the shoe are inserted through openings in the body 302 and attached to the securing member. The securing member is then inserted in the channels 70, 72 to secure the straps or upper to the sole. Once the securing member is inserted and secured in the channels 70, 72, the outer edges 306 of the bottom member 304 will move back to its initial position against the bottom surface 305 of the body 302 due to flexibility and resiliency of the material forming the bottom member.

Referring now to FIGS. 27-35, a further embodiment of an article of footwear is shown and generally designated by reference number 400, where the article of footwear 400 includes an outsole 402 and a strap assembly 404 having straps that are interconnected to each other by connecting members 406 and to the outsole by outsole connectors 408.

As shown in FIGS. 29 and 30, the outsole 402 is molded using ethylene vinyl acetate (EVA), rubber or any suitable material and includes four through-holes 410. The through-holes 410 are positioned on the outsole 402 so that two of the through-holes are located near the heel portion 412 of the outsole and two of the through-holes are located near the forefoot 414 of the outsole. As will be explained in more detail below, each of the through-holes 410 is an attachment location for a strap and is formed as an elongated slot that extends from the top surface 416 to the bottom surface 418 of the outsole 402.

In the illustrated embodiment, the strap assembly 404 (FIG. 31) includes a plurality of securing straps 420 that are attached to the outsole 402, and connecting straps 422 that are connected between two or more of the securing straps 420. All of the straps 420,422 are configured to be removable from the outsole 402 and replaceable or interchangeable with the same straps or different straps. For example, the securing straps 420 and the connecting straps 422 may all have the same design, same pattern and same color representing a designated footwear style. Alternatively, one or more of the securing straps 420 and the connecting straps 422 may be removed and replaced with a different connecting strap or a different securing strap which may have the same design, same pattern and/or same color or a different design, a different pattern and/or a different color to form the same footwear style or a different footwear style. The replaceability and interchangeability of the securing straps and the connecting straps enables a user to customize the present article of footwear according to their preferences. It also enables the user to be able to replace worn or damaged straps, i.e., the securing straps and the connecting straps, as needed to prolong the useful life of the article of footwear.

Each of the securing straps 420 is made of a first material such as a fabric material, a synthetic material or other suitable material. A first end 424 of each securing strap 420 is a free end that has a width and thickness that corresponds to the width and thickness of the through-holes 410 in the outsole 402, and a second, opposing end 426 of the securing strap is attached to one of the outsole connectors 408 by co-molding the securing strap with the outsole connector. Preferably, each outsole connector 408 is made of plastic or other durable material. Co-molding the outsole connector 408 to the end 426 of each securing strap 420 causes the material of the outsole connector 408 to engage and at least partially seep into the strap material to fixedly secure the outsole connector 408 to the securing strap 420 such that the outsole connector is not readily removable from the strap without damaging the outsole connector. This enhances the strength and durability of each securing strap 420 to help withstand the repeated use of the article of footwear 400. It should be appreciated that the article of footwear 400 may include one or a plurality of the through-holes 410 where the through-holes may be located at any suitable attachment location on the outsole 402 based on the strap assembly of the article of footwear. Similarly, the article of footwear 400 may include one or more of the securing straps 420 corresponding to the through-holes 410 in the outsole 402. Further, in an embodiment, at least a portion of one or more of the through-holes 410 has a cross-sectional length and/or width that is greater than a cross-sectional length and/or width of the securing strap so that a position of one or more of the securing straps relative to the outsole is adjustable to enable the straps to be adjusted to a wearer's foot for comfort and fit purposes.

As shown in FIGS. 27 and 31, the first end 424 of each of the securing straps 420 includes a loop 428 forming a channel 430 extending from one edge 432 to an opposing edge 434 of the strap. The loop 428 may be formed by folding the material of the securing strap 420 onto itself and stitching the ends of the material together or using a separate piece of the material and attaching it to the first end 424 of the securing strap by stitching, adhesive or other suitable attachment method.

The foot opening or portion of the article of footwear that is secured to a wearer's foot is formed by the connecting straps 422, which connect to each other and/or to the securing straps, and are made of the same or similar material as the securing straps 420. Alternatively, the connecting straps 422 may be made of a different material than the securing straps 420. In the illustrated embodiment, one of the connecting straps 422*a* includes opposing ends 436,438 each having a loop 440 formed by folding the material onto itself and stitching parts of the overlapping material pieces together. Another connecting strap 422*b* has an end 440 with a loop 442 and an opposing end 444 that is attached to an outsole connector 408 as described above. The connecting strap 422*b* also includes opposing surfaces 446*a*,446*b* where surface 446*a* includes a connecting material such as hook and loop members, i.e., Velcro®, having connecting loops at one end and the other surface 446*b* has hooks that engage and lock to the connecting loops when the connecting loops are secured to the hooks, or vice versa.

The connecting straps 422 are linked or connected together by one or more of the connecting members or rings 406. In an embodiment shown in FIGS. 32-33, one or more of the connecting members 406*a* has a triangular shape (FIG. 32) with one side having a gap or space 448*a* to enable the connecting straps 422 and/or the securing straps 420 to be moved or slid onto and attached to the connecting members. In the illustrated embodiment, the connecting members 406 are preferably made of a durable plastic but may be made with rubber or any suitable material or combination of materials. As shown in FIGS. 34 and 35, another embodiment of the connecting member 406*b* is illustrated where the connecting member has a D-shape with one side including the gap or space 448*b*. It should be appreciated that the connecting members or rings 406 may be any suitable size and shape and are replaceable if the connecting members become damaged, break or interchanged with a different connecting member. Additionally, the connecting members 406 may be formed with the same color, the same pattern and/or the same design, or a different color, a different pattern and/or a different design. In this way, the connecting members 406 are removable and replaceable to further customize the appearance of the article of footwear.

In use, the loop 428 at the end of each securing strap 420 and the end of connecting straps 422*b* are each inserted from the bottom surface 418 of the outsole 402 through the respective through-holes 410 until each strap extends out of the top surface 416 of the outsole. More specifically, on the inner or medial side 450 of the outsole 402, one of the securing straps 420 is attached near the heel portion 412 and another securing strap 420 is attached near the forefoot 414 of the outsole 402 where the securing strap includes a free end having a connecting material, such as Velcro®, that enables the free end to be inserted through a connecting member 406 and folded back onto itself and secured by the connecting material. As shown in the bottom view of the outsole 402, the bottom surface 418 of the outsole includes recessed areas 452 that extend to the outer peripheral edge 454 of the outsole 402 and have a size and shape that corresponds to the size and shape of the outsole connectors 408 such that when the securing straps 420 and the connecting strap 422 are inserted through the through-holes 410, the outsole connectors 408 are seated in or fit into the corresponding recessed areas 452 on the outsole such that the bottom surfaces 456 of the outsole connectors are substantially flush with the bottom surface 418 of the outsole 402.

As described above, the connecting straps 422 form the foot opening and are interconnected to each other by the connecting members, i.e., rings 406, as shown in FIG. 27 and as described above. The connecting straps 422 and the securing straps 420 are removed or disconnected from each other by moving or sliding each of the loops 428 out through the space or gap 448 in the connecting members. After the connecting straps 422 and the securing straps 420 are removed from the connecting members 406, each of the securing straps and the connecting strap are pulled through the respective through-holes 410 in the outsole 402 by grabbing the outsole connectors 408 at the bottom surface 418 of the outsole and pulling the securing straps 420 and the connecting straps 422 outwardly away from the bottom surface of the outsole until the straps are free or separated from the outsole 402.

Referring now to FIGS. 36-52, another embodiment of the present article of footwear is illustrated and generally designated as 458, and includes an outsole 460 and a strap assembly 462 where the strap assembly is secured to outsole by a plurality of removable outsole connectors 464. In this embodiment, the outsole 460 is made of a durable material such as EVA, rubber or other suitable material. A plurality of through-holes 466 are formed in the outsole 460 and extend from a top surface 468 to a bottom surface 470 of the outsole. As shown in FIGS. 36-38, each of the through-holes 466 are in locations on the outsole corresponding to desired attachment locations to the outsole for the ends of the straps 472 of the strap assembly 462. It should be appreciated that different styles of articles of footwear have different strap assemblies and thereby different strap attachment locations on the outsole. As such, the outsole 402 may include one or a plurality of the through-holes 466 located at different strap attachment locations on the outsole 460 corresponding to the strap configuration and strap attachment locations of a particular article of footwear.

Each of the through-holes 466 has an elongated slot shape with a cross-sectional length and width that is the same as or slightly greater than a cross-sectional length and width of the straps 472 so that the ends of each of the straps can be inserted into and through a corresponding through-hole from the top surface 468 to the bottom surface 470 of the outsole 460. Alternatively, the cross-sectional length and/or width of at least a portion of the through-holes 466 are greater than the cross-sectional length and/or width of the strap so that one or more of the positions of the straps may be adjusted relative to the outsole to customize the comfort and fit of the straps to a wearer's foot. Also, a recessed area or receptacle 474 is located at a bottom end of each of the through-holes 466 and is configured to receive an outsole connector 464 as described below. The recessed areas 474 each have a size and shape that correspond to a size and shape of the outsole connectors 464 which are each removably attached to the ends of the straps 472. As such, the ends of the straps 472 each include a loop 478 formed by a piece of loop material that is attached to the ends of the straps 472 by stitching. It should be appreciated that the loop material may be attached to the ends of the straps 472 by adhesive or another attachment method. Also, the loop material may be the same material used to form the straps 472 or a different material. It is contemplated that the material used to form the straps is a fabric, a synthetic material or any other suitable material. Similarly, the loop material may also be a fabric, a synthetic material or other suitable material.

Each of the ends of the straps 472 including the loops 478 are inserted through a corresponding through-hole 466 in the outsole 460 until the strap ends extend from the bottom surface 470 of the outsole. An outsole connector, such as the outsole connector 464*a* or 464*b* shown in FIG. 42 or FIG. 43, is secured to the loops 478 at the ends of the straps 472. In the embodiment shown in FIG. 42, the outsole connector 464*a* has a body 480 and a securing arm 482 attached to the body. The body 480 has a trapezoidal shape and is made out of a durable material such as plastic or rubber. It should be appreciated that the body 480 may be any suitable size and shape. In the illustrated embodiment, the top surface 484 of the body 480 includes a groove 486 where an end 488 of the securing arm 482 is attached to the body 480 in the groove during the molding process or using a suitable adhesive or other attachment method. The securing arm 482 has an L-shape such that the securing arm extends along and parallel to the groove 486 to a point that is spaced from the outer peripheral edge 490 of the body. The opposing, free end 492 of the securing arm 482 is not connected to the body and includes a hook 494 which helps to secure the loops 478 at the ends of the straps 472 as further described below. In the illustrated embodiment, the securing arm 482 is made out of a metal such as stainless steel but may be made of other suitable materials.

Another embodiment of the outsole connector 464*b* is shown in FIGS. 50-55 and includes a body 496 having a hexagon shape and a securing arm 498. The body 496 and the securing arm 498 are made of materials and attached together as described above. In this embodiment, the securing arm 498 is positioned in a groove 500 and attached to the body 496 in a center part of the body. Similar to above, one end 502 of the securing arm 498 is attached to the body 496 and the opposing, free end 504 of the securing arm extends over the body as shown in FIGS. 50, 54 and 55. Similar to the above embodiment, the free end 504 of the securing arm 498 has a hook 506 for securing the loops 478 at the ends of the straps 472 to the outsole connectors 464.

To secure the ends of the straps 472 to the outsole 460, the ends of the straps 472 are inserted through corresponding through-holes 466 from the top surface 468 to the bottom surface 470 of the outsole until the straps extend at least partially outwardly from the bottom surface of the outsole. Next, the free end 492,504 of the securing arm 482, 498 of one of the outsole connectors 464*a*,464*b* is inserted into and through the loop 478 at the end of the strap 472 until the hook extends from the opposing side of the loop. As stated above, the free end 492,504 of each securing arm 464*a*,464*b* is curved or bent downward to form the hook 494,506 and inhibit the inadvertent removal or sliding of the loop away from or off of the securing arm. Once the loop 478 is inserted over or onto the securing arm 482,498 of the outsole connector 464*a*,464*b*, the strap is pulled outwardly from the top surface 468 of the outsole 460 so that the outsole connector moves with the strap upwardly into the corresponding recessed area 474 on the bottom surface of the outsole. After the outsole connector 464*a*,464*b* is fully inserted into the recessed area, the bottom surface 508 of the outsole connector is substantially flush with the bottom surface 470 of the outsole. This process is repeated for each end of the straps 472 until the straps are each secured to the outsole 460 by the outsole connectors 464*a*,464*b*. Similar to the above embodiment, the straps 472 may all have the same designs, patterns or colors or different designs, patterns and colors. The outsole connectors 464 (464*a*,464*b*) are removable from the ends of the straps by moving the securing arm 482,498 outwardly from the loop 478 until the securing arm is disengaged from the loop. This enables a user to remove and replace one or more of the straps 472 to create different styles or to customize the article of footwear to their preferences.

While particular embodiments of articles of footwear have been shown and described, it will be appreciated by those skilled in the art that changes and modifications may be made thereto without departing from the invention in its broader aspects and as set forth in the following claims.

What is claimed is:

1. An article of footwear comprising:

an upper including a strap assembly, said strap assembly including a plurality of upper straps;

a plurality of removable connecting members configured to interconnect a plurality of said upper straps, at least one of said plurality of said upper straps being connected to two of said plurality of removable connecting members;

a sole including a top surface, a bottom surface, a peripheral side surface extending between said top surface and said bottom surface and a plurality of through-holes;

a plurality of outsole connectors removably connected to said sole, said plurality of outsole connectors each including at least one side surface and a bottom surface, and one of said upper straps being attached to one of said outsole connectors;

a plurality of securing straps, said securing straps attached to said outsole connectors and at least one of said securing straps being attached directly to one of said plurality of removable connecting members, wherein said plurality of removable connecting members are removable from said plurality of upper straps and said at least one of said securing straps, and wherein each of said securing straps of said outsole connectors and said one of said upper straps are inserted through a corresponding one of said through-holes until said at least one side surface of each outsole connector is positioned on said peripheral side surface of said sole and said bottom surface of each outsole connector is substantially flush with the bottom surface of said sole to secure the strap assembly to said sole.

2. The article of footwear of claim 1, wherein said plurality of removable connecting members are each configured to interconnect at least two of said plurality of upper straps.

3. The article of footwear of claim 1, wherein each of said outsole connectors is co-molded with a corresponding one of said securing straps or said one of said upper straps.

4. The article of footwear of claim 1, wherein each of said outsole connectors has a trapezoidal shape.

5. An article of footwear comprising:

an upper including a strap assembly, said strap assembly including a plurality of upper straps;

a plurality of removable connecting members, each of said plurality of removable connecting members being configured to interconnect a plurality of said upper straps, at least one of said plurality of said upper straps being connected to two of said plurality of removable connecting members and at least one connecting member of said plurality of removable connecting members including an opening so that one or more of said plurality of said upper straps are removable from said at least one connecting member;

a sole including a top surface, a bottom surface, a peripheral side surface extending between said top surface and said bottom surface and a plurality of through-holes that extend from said top surface to said bottom surface; and a plurality of outsole connectors removably connected to said sole, said plurality of outsole connectors each including at least one side surface and a bottom surface, and at least one of said outsole connectors including a base having a width and a length, and a connecting portion having a width and a length, wherein said width of said base is greater than said width of said connecting portion and said length of said base and said length of said connecting portion are equal;

a plurality of securing straps, each of said securing straps being attached to one of said outsole connectors and at least one of said outsole connectors being attached directly to one of said plurality of upper straps, wherein said plurality of removable connecting members are removable from said plurality of upper straps and said securing straps, and wherein each of said securing straps of said outsole connectors are inserted through a corresponding one of said through-holes until said at least one side surface of each outsole connector is positioned on said peripheral side surface of said sole and a bottom surface of each outsole connector is substantially flush with the bottom surface of said sole to secure the strap assembly to said sole.

6. The article of footwear of claim 1, wherein said base has a bottom surface and a top surface, and said connecting portion extends from said top surface of said base, wherein one of said securing straps is attached to said connecting portion.

7. The article of footwear of claim 5, wherein each of said outsole connectors has a trapezoidal shape.

* * * * *